US008550462B2

(12) United States Patent
Matsuki et al.

(10) Patent No.: US 8,550,462 B2
(45) Date of Patent: Oct. 8, 2013

(54) MECHANICAL DRAWING MACHINE AND GAME APPARATUS INCLUDING THE SAME

(75) Inventors: Daisuke Matsuki, Kanagawa (JP); Etsushi Torii, Kanagawa (JP); Hiroki Nakasato, Kanagawa (JP)

(73) Assignee: Konami Gaming Inc., Las Vegas, NV (US)

( * ) Notice: Subject to any disclaimer, the term of this patent is extended or adjusted under 35 U.S.C. 154(b) by 96 days.

(21) Appl. No.: 13/128,600

(22) PCT Filed: Nov. 9, 2009

(86) PCT No.: PCT/JP2009/069041
§ 371 (c)(1),
(2), (4) Date: May 10, 2011

(87) PCT Pub. No.: WO2010/058712
PCT Pub. Date: May 27, 2010

(65) Prior Publication Data

US 2011/0210510 A1 Sep. 1, 2011

(30) Foreign Application Priority Data

Nov. 20, 2008 (JP) ..... 2008-296979

(51) Int. Cl.
*A63F 3/06* (2006.01)
*A63F 9/24* (2006.01)

(52) U.S. Cl.
USPC ..... 273/142 E; 273/144 B; 273/138.2; 463/16

(58) Field of Classification Search
USPC ..... 273/142 E, 142 R, 142 A–142 D, 273/142 F, 142 G, 138.2, 144 B, 144 R; 463/16, 17
See application file for complete search history.

(56) References Cited

U.S. PATENT DOCUMENTS 5,639,089 A * 6/1997 Matsumoto et al. ..... 273/142 E

FOREIGN PATENT DOCUMENTS

GB 2449402 A 11/2008
JP H01-293889 A 11/1989

(Continued)

OTHER PUBLICATIONS

China Patent Office (SIPO), Office Action for 200980146515.X, Apr. 12, 2013.

(Continued)

*Primary Examiner* — Benjamin Layno

(57) ABSTRACT

It is an object to identify which of a plurality of rotationally moving drawing pockets a drawing object has entered into, without using a detecting means unit that moves together with the drawing pockets, from a result of detection by a fixedly arranged detecting means unit. The present mechanical drawing machine includes a drawing pocket forming member which can hold a drawing object having entered into each drawing pocket inside of the drawing pocket while rotationally moving so as to pass through a site adjacent to a stationary base, an object detecting unit which is provided on the stationary base, and detects that a drawing object which is held inside of the drawing pocket has passed through an object detecting site on an orbit of the drawing pockets, a mark forming and moving member which forms a plurality of mutually different marks corresponding to the drawing pockets, respectively, and rotationally moves the marks in synchronization with rotational movement of the drawing pocket forming member, a mark content reading unit which is provided on the stationary base, and reads a mark content when each mark passes through a mark detecting site on an orbit of the marks, and a pocket identifying unit which, based on a timing at which the object detecting unit detected passage of a drawing object or a mark content read by the mark content reading unit, identifies a drawing pocket into which the drawing object has entered.

15 Claims, 22 Drawing Sheets

(56) References Cited

FOREIGN PATENT DOCUMENTS

| | | | |
|---|---|---|---|
| JP | H04-224779 | A | 8/1992 |
| JP | H05-29575 | U | 4/1993 |
| JP | H06-246033 | A | 9/1994 |
| JP | 2002-136639 | A | 5/2002 |
| JP | 2004-49810 | A | 2/2004 |
| JP | 2005-000472 | A | 1/2005 |
| JP | 2007-215650 | A | 8/2007 |
| JP | 2007-215651 | A | 8/2007 |
| TW | 200738314 | A | 10/2007 |
| WO | 2007/094249 | A1 | 8/2007 |

OTHER PUBLICATIONS

Australian Patent Office (Australian Government IP Australia), Patent Examination Report No. 3 for AU patent application No. 2009318559, May 3, 2013.

International Search Report of corresponding International Application No. PCT/JP2009/069041, Jan. 12, 2010.

International Written Opinion of of corresponding International Application No. PCT/JP2009/069041, Jan. 12, 2010.

Australian Patent Office, Office Action for corresponding Australian Patent Application No. 2009318559.

Taiwanese Patent Office, Taiwanese Office Action for Corresponding application No. 098138694, Aug. 27, 2012.

Taiwanese Patent Office, Taiwanese Office Search Report Application No. 098138694, Aug. 27, 2012.

Japanese Patent Office, Japanese Office Action Application No. 2008-296979, Dec. 25, 2009.

Japanese Patent Office, Japanese Office Action Application No. 2008-296979, Jun. 11, 2010.

Australian Patent Office, Patent Examination Report No. 2 for AU patent application No. 2009318559, Jan. 30, 2013.

* cited by examiner

MECHANICAL DRAWING MACHINE AND GAME APPARATUS INCLUDING THE SAME

TECHNICAL FIELD

The present invention relates to a mechanical drawing machine which performs a drawing by moving a drawing object and depending on which of a plurality of drawing pockets said drawing object enters into and a game apparatus including the mechanical drawing machine.

BACKGROUND ART

As this type of mechanical drawing machine, there is provided one that performs a drawing, using a drawing object formed of an object in a spherical shape such as a ball or other shapes, depending on which of a plurality of drawing pockets the drawing object enters into. Such a mechanical drawing machine allows a drawer such as a player to actually visually check the drawing status while the mechanical drawing is performed. Accordingly, the drawer can intuitively realize that a drawing is being performed, which causes the drawer to be interested in the drawing. It can therefore be said that the mechanical drawing machine gains a higher level of drawing credibility from the drawer (credence that the drawing is random) than that of such a non-mechanical drawing machine that performs a drawing by a computer which executes a predetermined drawing program, and the drawing status of which cannot be visually checked by a drawer.

Patent Document 1 discloses a game apparatus including a plurality of mechanical drawing machines. This game apparatus is a token-operated game machine (game apparatus for business use) installed in a gaming facility such as a game center, and controls the progress of a so-called pusher game on the condition where tokens (bet objects) are received from a player, and tokens (payout objects) are paid out to the player when tokens inside a play field drop into a token dropping groove. In this game apparatus, when a ball supplied into the play field falls into the token dropping groove, the ball is delivered to a drawing machine (mechanical drawing mechanism) that performs a first stage of a mechanical drawing, and a mechanical drawing using the ball (drawing object) is performed in the drawing machine. Then, when the ball enters into a predetermined drawing pocket as a result of the drawing in the drawing machine, in a central drawing machine (mechanical drawing mechanism) that performs a second stage of a mechanical drawing, a further mechanical drawing is performed by using another ball.

The central drawing machine described in the above Patent Document 1 has a constitution including a ring-shaped body structure part, and in which a plurality of drawing pockets rotationally move so as to follow the body structure part. A detecting unit for detecting a ball is arranged in each drawing pocket, and as a result of a detection result from the detecting unit of the drawing pocket into which the ball has entered being sent to a control unit of the game apparatus body, the control unit can identify the drawing pocket into which the ball has entered.

Patent Document 1: Japanese Published Unexamined Patent Application No. 2007-215650

DISCLOSURE OF THE INVENTION

Problems to be Solved by the Invention

However, the drawing pocket in which each detecting unit is arranged rotationally moves, whereas the control unit of the game apparatus body that receives its detection result is fixedly arranged. In such a constitution, when a low-cost line transmission system is adopted as a transmission system for transmitting a detection result signal output from each detecting unit to the control unit, such a contact that the side which moves along with the detecting unit on its signal transmission path and the fixing side where the control unit is provided move relatively with each other is produced. If such a contact is present on the signal transmission path, stable transmission of a detection result signal becomes difficult. On the other hand, when a radio transmission system is adopted as a transmission system, stable transmission of a detection result signal becomes possible, but the cost rises steeply. Therefore, in the above-described constitution, there has been a problem that it is difficult to realize stable transmission of a detection result of each detecting unit to the control unit at a low cost.

The present invention realizes a mechanical drawing machine capable of identifying which of a plurality of rotationally moving drawing pockets a drawing object has entered into, without using a detecting unit that moves together with the drawing pockets, from a result of detection by a fixedly arranged detecting unit and a game apparatus including the mechanical drawing machine.

Means for Solving the Problem

As an aspect of the present invention, it is listed that a mechanical drawing machine which performs a drawing by moving a drawing object and depending on which of a plurality of drawing pockets the drawing object enters into, includes a stationary base; a drawing pocket forming member which forms the drawing pockets, and can hold a drawing object having entered into each drawing pocket inside of the drawing pocket while rotationally moving so as to pass through a site adjacent to the stationary base; a driving unit which drives the drawing pocket forming member so as to rotationally move; an object detecting unit which is provided on the stationary base, and detects that a drawing object which is held inside of the drawing pocket has passed through an object detecting site on an orbit of the drawing pockets; a mark forming and moving member which forms a plurality of mutually different marks corresponding to the drawing pockets, respectively, and rotationally moves the marks in synchronization with rotational movement of the drawing pocket forming member; a mark content reading unit which is provided on the stationary base, and reads a mark content when each mark passes through a mark detecting site on an orbit of the marks; and a pocket identifying unit which, based on a timing at which the object detecting unit detected passage of a drawing object or a mark content read by the mark content reading unit, identifies a drawing pocket into which the drawing object has entered.

In this mechanical drawing machine, rotational movement of a plurality of marks is in synchronization with rotational movement of drawing pockets corresponding to the marks. Therefore, the relationship between the position on the orbit of the drawing pockets and the position on the orbit of the marks corresponding to the drawing pocket has a one to one relationship. The correspondence between the point in time where the object detecting unit has detected that a drawing object which is held inside of the drawing pocket passes through an object detecting site and a mark that passes through a mark detecting site at the point in time or a point in time after a predetermined time has elapsed since the point in time or before the elapse of a predetermined time prior to the point in time also have a one to one relationship. Therefore, a drawing pocket into which a drawing object has entered can be identified from the timing at which the object detecting unit detected passage of the drawing object and the mark content read by the mark content reading unit. Thus, which of the rotationally moving drawing pockets the drawing object has entered into can be identified from the detection results of the object detecting unit and mark content reading unit that are both provided on the stationary base.

In addition, in the mechanical drawing machine, the marks may be different in combination of the presence and absence of a plurality of mark pieces from each other, and the mark content reading unit may detect the presence and absence of the mark pieces by mark piece detecting sensors of the same number as the maximum number of the mark pieces when each mark passes through the mark detecting site, and read a combination of detection results of the mark piece detecting sensors as the mark content.

When a mark that is different in combination of the presence and absence of a plurality of mark pieces is used, methods for reading its mark content (combination of the presence and absence of a plurality of mark pieces) by the fixedly arranged mark content reading unit that can be considered include a method for sequentially reading the presence and absence of a plurality of mark pieces that sequentially pass through its mark detecting site by a single sensor and a method for sequentially reading the presence and absence of a plurality of mark pieces in its mark detecting site by sensors of the same number as the maximum number of the mark pieces. The former method has an advantage that it suffices with one sensor, but has disadvantages such as making it necessary to control variations in the moving speed of the mark pieces at high accuracy, and it takes a long time to read the mark content because the content of its mark cannot be fixed until the maximum number of mark pieces have passed through the mark detecting site.

Therefore, in the present mechanical drawing machine, the latter method is adopted. Accordingly, when a mark is present in the mark detecting site, the combination of the presence and absence of a plurality of mark pieces in the mark can be obtained at one time, and thus there are no such disadvantages as described above. Particularly, in a mechanical drawing, it is desired, when a drawing object has entered into a drawing pocket, to identify the drawing pocket into which the drawing object has entered at a timing as early as possible, and perform a performance process and other processes according to the identified drawing pocket. This is because, in the mechanical drawing, where it is usual to allow a drawer to grasp the situation in which a drawing object enters into a drawing pocket, a large difference between the point in time where the drawer has grasped a drawing pocket into which a drawing object has entered and the point in time where a performance process and so on to be carried out as a result of the drawing object entering into that drawing pocket is started brings about an unpleasant feeling for the drawer, resulting in the possibility that the fun of the mechanical drawing is reduced. The effect, as in the present mechanical drawing machine, that reading of the mark content can be carried out in a short time by obtaining at one time the combination of the presence and absence of a plurality of mark pieces composing a mark can reduce the unpleasant feeling to be brought to the drawer, and can thus lower the possibility that the fun of the mechanical drawing is reduced, which is very advantageous.

Although, in the present mechanical drawing machine, mark piece detecting sensors of the same number as the maximum number of a plurality of mark pieces composing a mark are required, this does not become a practical disadvantage because such mark piece sensors are available at very low prices.

Also, the mechanical drawing machine may further include a mark content storage unit which stores at least the latest mark content out of the mark contents read by the mark content reading unit every time each mark passes through the mark detecting site, wherein the pocket identifying unit, based on the latest mark content stored in the mark content storage unit when the object detecting unit has detected passage of a drawing object, may identify a drawing pocket into which the drawing object has entered.

In this mechanical drawing device, a drawing pocket into which a drawing object has entered can be identified based on the latest mark content already stored in the mark content storage unit at the point in time where the object detecting unit has detected passage of the drawing object. Therefore, a drawing pocket into which a drawing object has entered can be identified at an earlier timing than that in the case of identifying a drawing pocket into which a drawing object has entered based on the mark content read by the mark content reading unit at or after the point in time where the object detecting unit has detected passage of the drawing object. As described above, in a mechanical drawing, a large difference between the point in time where the drawer has grasped a drawing pocket into which a drawing object has entered and the point in time where a performance process and so on to be carried out as a result of the drawing object entering into that drawing pocket is started brings about an unpleasant feeling for the drawer, resulting in the possibility that the fun of the mechanical drawing is reduced. The effect, as in the present mechanical drawing machine, that a drawing pocket into which a drawing object has entered can be identified at an early timing can reduce the unpleasant feeling to be brought to the drawer, and can thus lower the possibility that the fun of the mechanical drawing is reduced, which is very advantageous.

Even by the method for identifying a drawing pocket into which a drawing object has entered based on the mark content read at or after the point in time of detection by the object detecting unit, by reading the mark content at a point in time as close as possible to that of detection by the object detecting unit, a drawing pocket into which a drawing object has entered can be identified at a relatively early timing. However, when there is a large error in detection timing of the object detecting unit in the case of passage of the drawing object through the object detecting site, it is necessary to set the time interval between the point in time of detection by the object detecting unit and the point in time to read the mark content sufficiently long in consideration of that error. Therefore, in such a case, it is difficult to identify a drawing pocket into which the drawing object has entered at an early timing. On the other hand, according to the present mechanical drawing machine, even in such a case, it suffices to set the time interval between the point in time of detection by the object detecting unit and the point in time to read the latest mark content (earlier point in time than the point in time of detection) in consideration of that error, but even by such a setting, since identification of a drawing pocket into which the drawing object has entered remains based on the latest mark content already stored in the mark content storage unit at the point in time of detection by the object detecting unit, there is still an advantage that a drawing pocket into which the drawing object has entered can be identified at an early timing.

Also, in the mechanical drawing machine, the pocket identifying unit, based on a mark content read by the mark content reading unit when or after the object detecting unit has detected passage of a drawing object, may identify a drawing pocket into which the drawing object has entered.

In this mechanical drawing machine, a drawing pocket into which a drawing object has entered can be identified based on the mark content read at or after the point in time where the object detecting unit has detected passage of the drawing object. In the case of identifying a drawing pocket into which a drawing object has entered based on the latest mark content already stored in the mark content storage unit at the point in time where the object detecting site has detected passage of the drawing object, it is necessary to always read the content of a mark by the mark content reading unit and store the mark content in the mark content storage unit until the object detecting unit detects passage of the drawing object. On the other hand, in the present mechanical drawing machine, since it is unnecessary to have read the content of a mark by the mark content reading unit until the object detecting unit detects passage of the drawing object, it is also unnecessary to have stored the mark content in the mark content storage unit. Therefore, not only is the process simplified, but the constitution can also be simplified since the mark content storage unit can be omitted.

As another aspect of the present invention, it is listed that a mechanical drawing machine which performs a drawing by moving a drawing object and depending on which of a plurality of drawing pockets the drawing object enters into, includes a stationary base; a drawing pocket forming member which forms the drawing pockets, and can hold a drawing object having entered into each drawing pocket inside of the drawing pocket while rotationally moving so as to pass through a site adjacent to the stationary base; a driving unit which drives the drawing pocket forming member so as to rotationally move; an object detecting unit which is provided on the stationary base, and detects that the drawing object which is held inside of the drawing pocket has passed through an object detecting site on an orbit of the drawing pockets; a mark forming and moving member which rotationally moves one or two or more marks in synchronization with rotational movement of the drawing pocket forming member; a mark detecting unit which is provided on the stationary base, and detects that the one or two or more marks have passed through a mark detecting site on an orbit of the mark or marks; and a pocket identifying unit which, based on a timing at which the object detecting unit detected passage of a drawing object or a timing at which the mark detecting unit detected passage of a mark, identifies a drawing pocket into which the drawing object has entered.

In this mechanical drawing machine, rotational movement of one or two or more marks is in synchronization with rotational movement of a plurality of drawing pockets. Therefore, the relationship between the individual positions on the orbit of the drawing pockets and the position on the orbit of one or two or more marks has a one to one relationship. The correspondence between the point in time where the object detecting unit has detected that a drawing object which is held passes through an object detecting site and a time elapsed from that point in time until the mark detecting unit detects that a mark first passes through the mark detecting site also has a one to one relationship. Therefore, a drawing pocket into which a drawing object has entered can be identified from the timing at which the object detecting unit detected passage of the drawing object and the timing at which the mark detecting unit detected passage of a mark. Thus, which of the rotationally moving drawing pockets the drawing object has entered into can be identified from the detection results of the object detecting unit and mark detecting unit that are both provided on the stationary base.

In addition, in the mechanical drawing machine, the mark forming and moving member may be fixed to the drawing pocket forming member so that the marks may rotationally move as a result of driving of the drawing pocket forming member.

In this mechanical drawing machine, the constitution of rotationally moving marks in conjunction with a movement of the drawing pocket forming member with the same period as that of a rotational movement of a plurality of drawing pockets can be realized by a simple constitution.

Also, in the mechanical drawing machine, a plurality of object detecting units may be provided so as to be able to detect that a drawing object which is held inside of the drawing pocket has passed through a plurality of mutually different object detecting sites on an orbit of the drawing pockets.

For the position, posture, and so on of a drawing object held in the drawing pocket, malfunction of the object detecting unit, and other reasons, such a situation that the drawing object is not detected by an object detecting unit when it passes through an object detecting site can occur. In such a case, when there is provided only one object detecting unit, such a situation occurs that the period, after a drawing object enters into a drawing pocket, until detecting the drawing pocket into which the drawing object has entered is prolonged, or the drawing pocket into which the drawing object has entered can never be identified in some cases.

In the present mechanical drawing machine, since there are provided a plurality of object detecting units, such a situation as in the above can be made less likely to occur than in the case with only one object detecting unit.

Also, in the mechanical drawing machine, at least two or more object detecting sites out of the object detecting sites may be dispersed in a region where a plurality of drawing pockets to which a drawing object is accessible are located.

In this mechanical drawing machine, a drawing object that has entered into a drawing pocket inside of the above-described region (hereinafter, referred to as an "accessible region") is detected by the object detecting unit at an object detecting site the drawing object passes through first inside of the accessible region. Further, according to the present mechanical drawing machine, since two or more object detecting sites are dispersedly arranged in the accessible region, it becomes possible, even when the drawing object enters into the drawing pocket at any position inside of the accessible region, to detect this within the time required for the drawing object to move between the object detecting sites after the drawing object entered into the drawing pocket. Accordingly, variation in the time required after a drawing object entering into a drawing pocket until identifying the drawing pocket into which the drawing object has entered can be reduced.

Also, in the mechanical drawing machine, the object detecting site may be arranged on a downstream side in a drawing pocket-rotational movement direction of a region where a drawing pocket to which a drawing object is accessible is located.

In this mechanical drawing machine, an object detecting site is arranged outside of the accessible region on a side downstream in the drawing pocket-rotational movement direction (hereinafter, simply referred to as "downstream") with respect to the accessible region, and thus, even when a drawing object enters into a drawing pocket at any position inside of the accessible region, the drawing object can be detected at this object detecting site. Particularly, in the case where object detecting sites are arranged only inside of the accessible region, when a drawing object has entered into a drawing pocket in an accessible region part at a more downstream side than the object detecting site located most downstream inside the accessible region, the drawing object is not detected until it again reaches the accessible region with a rotational movement of drawing pockets and passes through an object detecting site located most upstream inside the accessible region. On the other hand, according to the present mechanical drawing machine, even in this case, the drawing object is detected by exiting from the accessible region and passing through the object detecting site arranged on the downstream side of the accessible region, and thus it becomes possible to detect the drawing object without waiting for this again reaching the accessible region.

As another aspect of the present invention, it is listed that a game apparatus includes a mechanical drawing machine which performs a drawing by moving a drawing object and depending on which of a plurality of drawing pockets the drawing object enters into; and a game progress control unit which performs control of game progress by use of a result of a mechanical drawing using the mechanical drawing machine by executing a predetermined game program, or controls game progress by executing a predetermined game program and performs control to start a mechanical drawing using the mechanical drawing machine according to a result of the game progress, wherein the mechanical drawing machine includes a stationary base; a drawing pocket forming member which forms the drawing pockets, and can hold a drawing object having entered into each drawing pocket inside of the drawing pocket while rotationally moving so as to pass through a site adjacent to the stationary base; a driving unit which drives the drawing pocket forming member so as to rotationally move; an object detecting unit which is provided on the stationary base, and detects that a drawing object which is held inside of the drawing pocket has passed through an object detecting site on an orbit of the drawing pockets; a mark forming and moving member which forms a plurality of mutually different marks corresponding to the drawing pockets, respectively, and rotationally moves the marks in synchronization with rotational movement of the drawing pocket forming member; a mark content reading unit which is provided on the stationary base, and reads a mark content when each mark passes through a mark detecting site on an orbit of the marks; and a pocket identifying unit which, based on a timing at which the object detecting unit detected passage of a drawing object or a mark content read by the mark content reading unit, identifies a drawing pocket into which the drawing object has entered.

And also, as another aspect of the present invention, it is listed that a game apparatus includes a mechanical drawing machine which performs a drawing by moving a drawing object and depending on which of a plurality of drawing pockets the drawing object enters into; and a game progress control unit which performs control of game progress by use of a result of a mechanical drawing using the mechanical drawing machine by executing a predetermined game program, or controls game progress by executing a predetermined game program and performs control to start a mechanical drawing using the mechanical drawing machine according to a result of the game progress, wherein the mechanical drawing machine includes a stationary base; a drawing pocket forming member which forms the drawing pockets, and can hold a drawing object having entered into each drawing pocket inside of the drawing pocket while rotationally moving so as to pass through a site adjacent to the stationary base; a driving unit which drives the drawing pocket forming member so as to rotationally move; an object detecting unit which is provided on the stationary base, and detects that a drawing object which is held inside of the drawing pocket has passed through an object detecting site on an orbit of the drawing pockets; a mark forming and moving member which rotationally moves one or two or more marks in synchronization with rotational movement of the drawing pocket forming member; a mark detecting unit which is provided on the stationary base, and detects that the one or two or more marks have passed through a mark detecting site on an orbit of the mark or marks; and a pocket identifying unit which, based on a timing at which the object detecting unit detected passage of a drawing object or a timing at which the mark detecting unit detected passage of a mark, identifies a drawing pocket into which the drawing object has entered.

In these game apparatuses, since the foregoing mechanical drawing machine is used, which of the rotationally moving drawing pockets a drawing object has entered into can be identified, without using a detection result of a detecting unit that rotationally moves together with a plurality of drawing pockets, from a result of detection by a fixedly arranged detecting unit.

Effect of the Invention

According to the present invention, which of a plurality of rotationally moving drawing pockets a drawing object has entered into can be identified, without using a detecting unit that moves together with the drawing pockets, from a result of detection by a fixedly arranged detecting unit.

DESCRIPTION OF REFERENCE NUMERALS

1: Token-operated Game Machine
2: Station Unit
3: Center Drawing Apparatus
11: Touch Panel
20: Station Control Device
30: Central Control Device
40: Vertical Ring Drawing Device
41, 51: Drawing Pocket
50: Inclined Ring Drawing Device
60: Device Supporting Base
71, 72, Display Device
73: Drawing Ball
80: Ball Transfer Device
81: Transfer Channel Switching Device
82: First Transfer Rail
83: Ball Drop-in Standby Unit
84: Second Transfer Rail
85: Third Transfer Rail
86: Fourth Transfer Rail

BEST MODE FOR CARRYING OUT THE INVENTION

Hereinafter, one embodiment in which the present invention is applied to a token-operated game machine serving as a game apparatus for business use (arcade gaming machine) including a mechanical drawing machine will be described with reference to the drawings.

In addition, each of the drawings merely shows the shape, dimensions and positional relationship briefly to such an extent that is helpful in understanding the content of the present invention. The present invention shall not be therefore limited only to the shape, dimensions or positional relationship shown in each of the drawings. Further, in each of the drawings, in order to make a constitution clear, a part of the hatching on the cross section is omitted. Still further, a value to be exemplified later is only a preferable example of the present invention, and therefore the present invention shall not be limited to the exemplified value.

Figure 1:
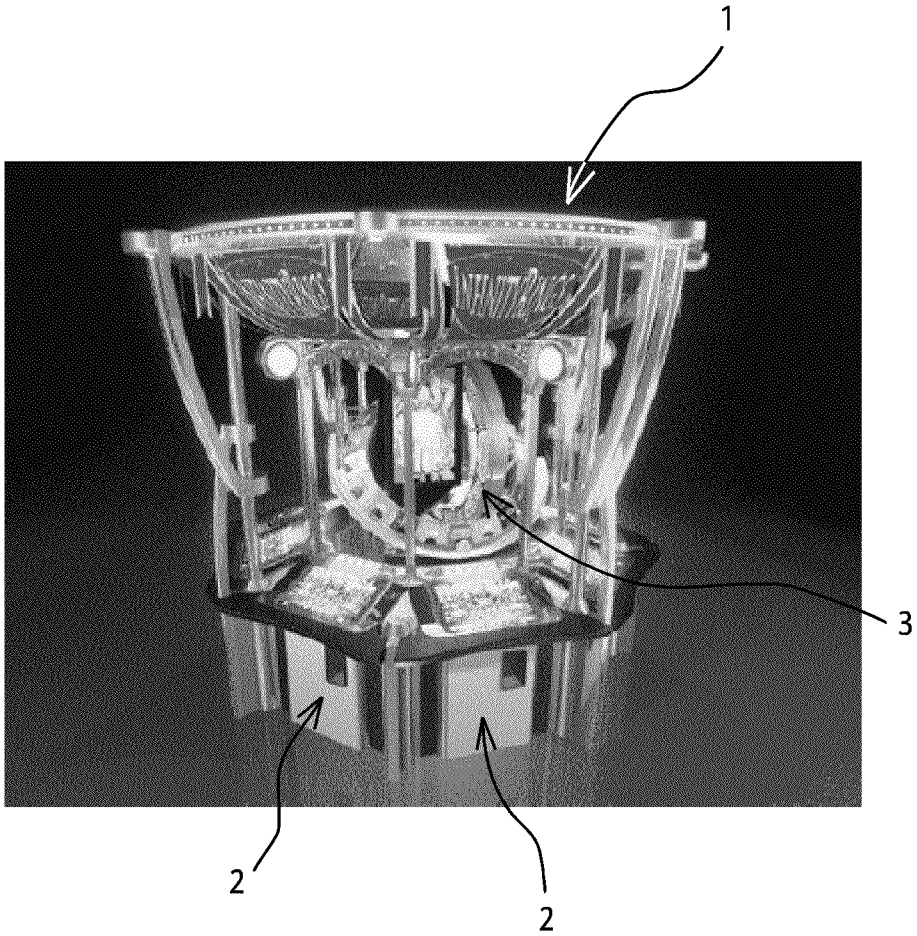
FIG. 1 is a partial perspective view showing an overall configuration of a token-operated game machine according to the embodiment.

FIG. 1 is a partial perspective view showing an overall configuration of a token-operated game machine 1 according to the present embodiment.

The token-operated game machine 1 includes eight station units 2 so as to surround a center drawing apparatus 3, which is a mechanical drawing machine, so that players play games at the station units 2, respectively.

Figure 2:
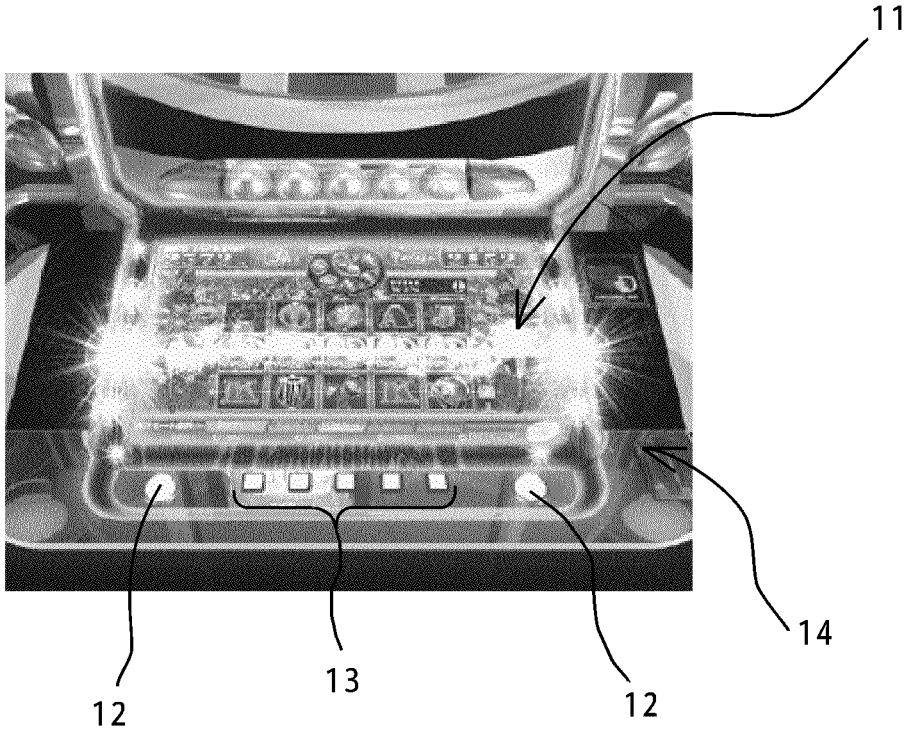
FIG. 2 is a perspective view showing an upper portion of the station unit in the token-operated game machine.

FIG. 2 is a perspective view showing an upper portion of the station unit 2 in the token-operated game machine 1.

The station unit 2 is provided, on an upper portion of a housing, with a touch panel 11 serving as a display unit and operation unit functioning as display means and operation means, a start button 12 and a BET-mode selection button 13 serving as an operation unit functioning as operation means, a token drop-in opening 14 constituting a bet object accepting unit functioning as bet object accepting means, and so on. A game screen is displayed on the touch panel 11, and a player plays the game by observing the display on the game screen while operating the touch panel 11 and the various buttons 12, 13. In the present embodiment, description is given for an example of the case where the game to be carried out in the station unit 2 is a slot game (symbol matching play), but the type of game to be carried out in the station unit 2 is not limited to this. It is noted that the slot game is a game to cause a varying display of a plurality of types of symbols, and if a symbol that is stopped and displayed when the varying display is then stopped, or a pattern of a plurality of stopped and displayed symbols corresponds to a predetermined award, award the player a predetermined benefit.

Figure 3:
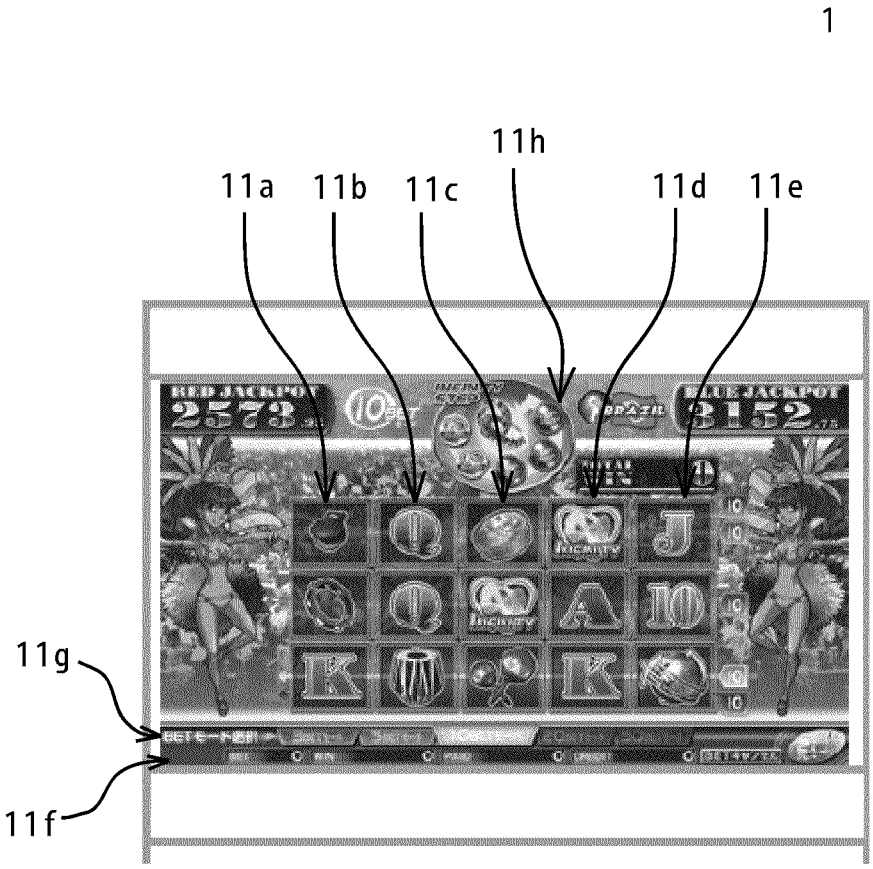
FIG. 3 is a view for explaining one example of a game screen displayed on the touch panel of the station unit.

FIG. 3 is a view for explaining one example of a game screen displayed on the touch panel 11 of the station unit 2.

On the game screen displayed on the touch panel 11, a plurality of symbols of two types or more arrayed in a predetermined order are displayed in each of the five symbol display regions 11*a* to 11*e*. Moreover, on the touch panel 11, in addition to the symbol display regions, a display unit 11*f* that displays various types of information necessary for the game, such as a credit display unit that displays the quantity of credit corresponding to the number of tokens dropped from the token drop-in opening 5*a* by the player, is also displayed in a lower portion of the game screen. Further, in the lower portion of the game screen, a BET-mode display unit 11*g* corresponding to each of the five mode selection buttons 13 is also displayed. In the present embodiment, part or all of the operations other than the operation for the mechanical buttons 12, 13 are performed by various types of operating images displayed on the touch panel 11, but mechanical buttons may be provided in place of the operating images, or conversely, the operating image of the touch panel 11 may be used in place of the mechanical buttons 12, 13.

Moreover, inside of the station unit 2, although not shown, a station control device that is constituted with an electronic circuit formed of a CPU, a ROM, and other various electronic components, an inspection device for checking if the received tokens are unauthorized tokens, a token payback device capable of containing a large number of tokens and for discharging to the outside tokens of a number instructed by the station control device, a speaker serving as a sound outputting unit functioning as sound outputting means, and other components are also incorporated.

Figure 4:
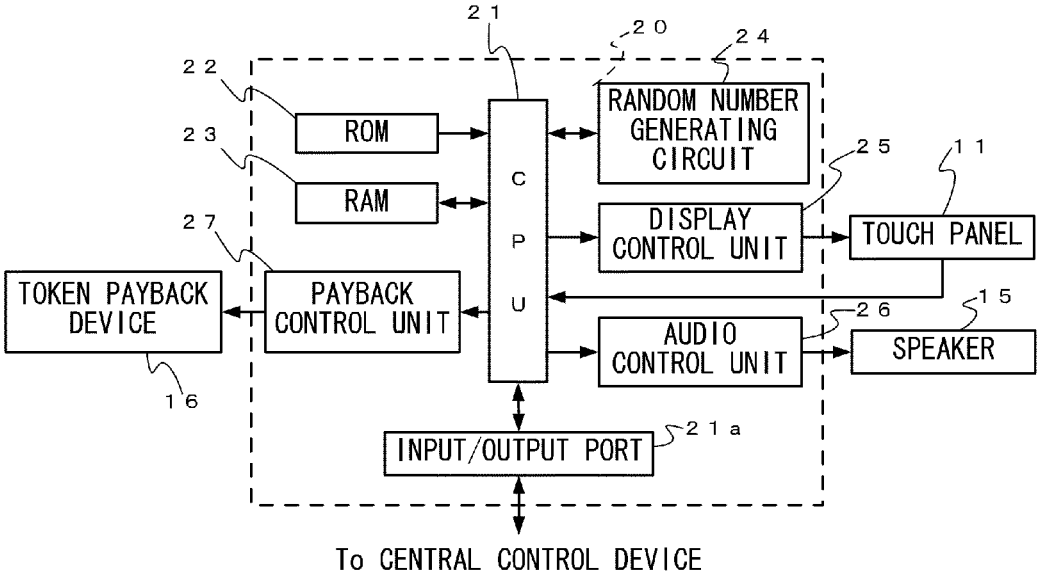
FIG. 4 is a block diagram showing a schematic configuration of a station control device that controls the station unit.

FIG. 4 is a block diagram showing a schematic configuration of a station control device 20 that controls the station unit 2.

The station control device 20 is constituted with a CPU 21, an input/output port 21*a*, a ROM 22, a RAM 23, a random number generating circuit 24, a display control unit 25, an audio control unit 26, a payback control unit 27, and so on. The input/output port 21*a* is used for performing data communications with a central control device 30 to be described later. The ROM 22 stores data such as various types of programs and various types of databases to be used by the CPU 21, and outputs these to the CPU 21. The RAM 23 temporarily stores variable data calculated by the CPU 21 and the like or stores various types of varying data such as credit data. The random number generating circuit 24 generates a random number at a predetermined timing and outputs its data to the CPU 21. The display control unit 25 constitutes a display unit with the touch panel 11, and under the control of the CPU 21, performs display control of the touch panel 11 that displays a game screen and the like. The audio control unit 26, under the control of the CPU 21, controls a voice announcement, a performance sound, or the like to be output from the speaker 15. The payback control unit 27, under the control of the CPU 21, controls the token payback device 16 to pay back tokens. The CPU 21 is also connected to, for example, a token counter (not shown) that counts the number of tokens dropped in the token drop-in opening and an illumination control unit that controls illumination such as an LED.

Next, the operation of the respective units will be described along the flow of a slot game to be carried out in the station unit 2.

Figure 5:
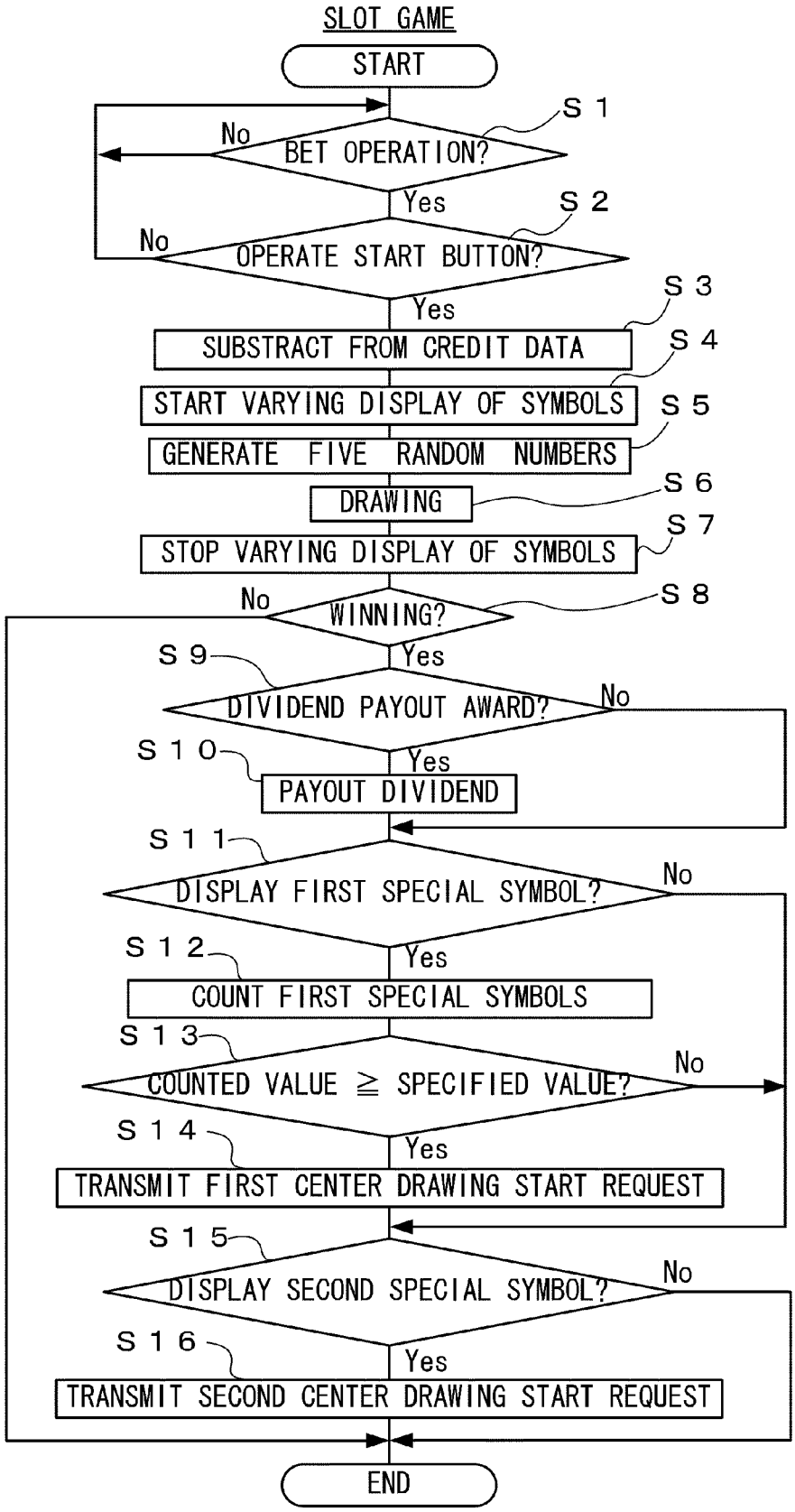
FIG. 5 is a flowchart showing the flow of one slot game executed by the station unit.

FIG. 5 is a flowchart showing the flow of one slot game.

When tokens (not shown) are dropped in the token drop-in opening 5*a* by the player, the tokens etc., are counted by the token counter. Then, the token counter outputs dropped token data to the CPU 21 of the station control device 20. The CPU 21 that has received the dropped token data performs a process for adding the credit quantity corresponding to the dropped token data to the credit data of the RAM 23. When credit that has been deposited in advance in the gaming facility is withdrawn by performing a credit withdrawing process and used, credit data corresponding to the withdrawn credit is stored in the RAM 23.

The player, after determining the desired number of winning lines and the betting credit quantity, touches the touch panel 11 to select winning lines, and selects a BET mode by pressing any of the five mode selection buttons 13 to determine how much credit will be paid for each winning line (S1). This operation content is sent as a BET operation signal to the CPU 21 of the station control device 20. The CPU 21 that has received the BET operation signal brings about a state where an operation signal from the start button 12 can be received. Accordingly, an operation of the start button 12 by the player is made effective.

When the player operates the start button 12 (S2), the CPU 21 of the station control device 20 serving as a bet object receiving unit functions as bet object receiving means to perform a bet receiving process for subtracting from the credit data of the RAM 23 the credit quantity according to the BET operation signal, that is, the credit quantity equivalent obtained by multiplying the credit quantity corresponding to the selected BET mode by the number of selected winning lines (S3). Thereafter, the CPU 21 serving as a start signal generating unit functions as start signal generating means to generate a start signal, and sends the start signal to the display control unit 25. The display control unit 25, upon receiving the start signal, performs varying display control that sequentially switches symbols to be displayed in the respective symbol display regions 11*a* to 11*e* of the touch panel 11 (S4).

The CPU 21 also sends the generated start signal to the random number generating circuit 24. The random number generating circuit 24 that has received the start signal generates five random numbers (S5), and sequentially sends these random numbers to the CPU 21. The random numbers correspond to the symbol displaying regions 11*a* to 11*e* to be displayed on the touch panel 11, respectively. The CPU 21 serving as a stop symbol determining unit functions as stop symbol determining means in cooperation with the random number generating circuit 24, and upon receiving the five random numbers sent from the random number generating circuit 24, compares the random numbers with stop position tables stored in the ROM 22. These stop position tables are individually prepared for each of the symbol display regions 11*a* to 11*e*. Then, the stop positions of varying displays in the symbol display regions 11*a* to 11*e* are determined based on the random numbers and stop position tables. Therefore, the symbols to be stopped and displayed in the symbol display regions 11*a* to 11*e*, respectively, are determined based on the five random numbers sent from the random number generating circuit 24.

On the other hand, the CPU 21 serving as a winning deciding unit functions as winning deciding means in cooperation with the random number generating circuit 24, and upon receiving the five random numbers sent from the random number generating circuit 24, also performs a drawing process for comparing a combination of these random numbers with winning determination tables stored in the ROM 22 to determine whether a predetermined award has been won or the number of first and second special symbols that have been stopped and displayed (S6). In the present embodiment, awards are roughly divided into a payout award (dividend payout award) to pay out the quantity of credit corresponding to the award to the player, a first center drawing award for performing a first center drawing in the center drawing apparatus 3 to be described later, and a second center drawing award for performing a second center drawing in the center drawing apparatus 3 to be described later. Then, the CPU 21, based on the combination of random numbers and winning determination tables, determines an award to be won by this game, or determines loss in which any award is not won. In the ROM 22, at least two types of winning determination tables to be used during a normal game and to be used during a free game to be described later are stored. Further, with respect to the former winning determination table, individual winning determination tables are prepared for each number of winning lines that can be selected.

The CPU 21, having completed the above-described drawing process, controls the display control unit 25 so that varying displays in the symbol display regions 11*a* to 11*e* respectively stop at the determined stop positions (S7). Accordingly, in the symbol displaying regions 11*a* to 11*e* of the touch panel 11, varying displays stop at the determined stop positions, so that symbols corresponding to the above-described five random numbers are stopped and displayed in the symbol displaying regions 11*a* to 11*e*.

When winning of the dividend payout award has been determined in the above-described drawing process (Yes in S8, Yes in S9), the CPU 21 of the station control device 20, after the varying displays in the symbol display regions 11*a* to 11*e* are stopped and displayed, outputs predetermined performance signals to the illumination control unit and the audio control unit 26, respectively. Accordingly, the illumination control unit performs control to make the illumination such as an LED emit light in a pattern according to the performance signal. The audio control unit 26 performs control to make a sound effect according to the performance signal be output from the speaker 15. Further, the CPU 21 serving as a payout processing unit functions as payout processing means to perform a payout process for adding the credit quantity equivalent according to the won award to the credit data stored in the RAM 23 (S10).

Further, when it has been determined in the above-described drawing process to stop and display first special symbols (Yes in S11), the CPU 21 of the station control device 20, after the varying displays in the symbol display regions 11*a* to 11*e* are stopped and displayed, outputs predetermined performance signals to the illumination control unit and the audio control unit 26, respectively, to carry out predetermined performances. Subsequently, the CPU 21 adds to retention count data of first special symbols stored in the RAM 23 the number of stopped and displayed first special symbols (S12). Thereafter, the CPU 21 sends the retention count data stored in the RAM 23 to the display control unit 25, and the display control unit 25, according to the number corresponding to the retention count data, updates the display in a retention count display unit 11*h* (refer to FIG. 3) showing the retention count of first special symbols. Further, the CPU 21 determines whether the retention count data stored in the RAM 23 has reached a specified value (which is "5" in the present embodiment) or more (S13). When it has been determined by this determination that the data has reached the specified value or more, the CPU 21 outputs predetermined performance signals to the illumination control unit and the audio control unit 26, respectively, to perform predetermined performance. Further, the CPU 21, after subtracting the specified value equivalent from the retention count data, sends the retention count data after subtraction stored in the RAM 23 to the display control unit 25, and the display control unit 25, according to the number corresponding to the retention count data, updates the display in the retention count display unit 11*h* showing the retention count of first special symbols. Then, the CPU 21 transmits a first center drawing start request to the central control device from the input/output port 21*a* (S14). Accordingly, in the center drawing apparatus 3, a first center drawing to be described later is performed.

Further, when it has been determined in the above-described drawing process to stop and display second special symbols (Yes in S15), the CPU 21 of the station control device 20, after the varying displays in the symbol display regions 11*a* to 11*e* are stopped and displayed, outputs predetermined performance signals to the illumination control unit and the audio control unit 26, respectively, to carry out predetermined performances. Then, the CPU 21 transmits a second center drawing start request to the central control device from the input/output port 21*a*. Accordingly, in the center drawing apparatus 3, a second center drawing to be described later is performed.

Next, the configuration of the center drawing apparatus 3 will be described.

Figure 6:
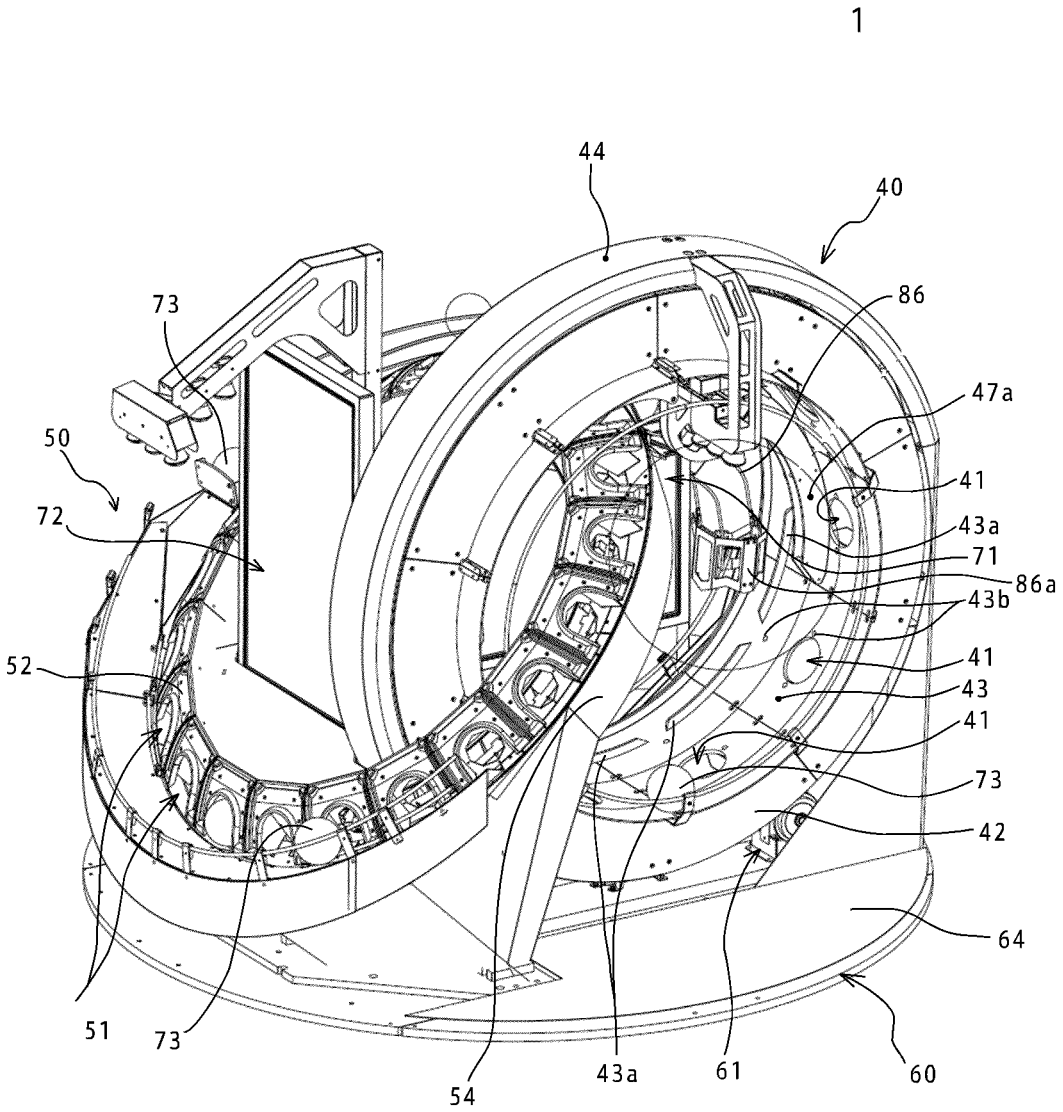
FIG. 6 is a perspective view of a center drawing apparatus in the token-operated game machine.

FIG. 6 is a perspective view of the center drawing apparatus 3.

Figure 7:
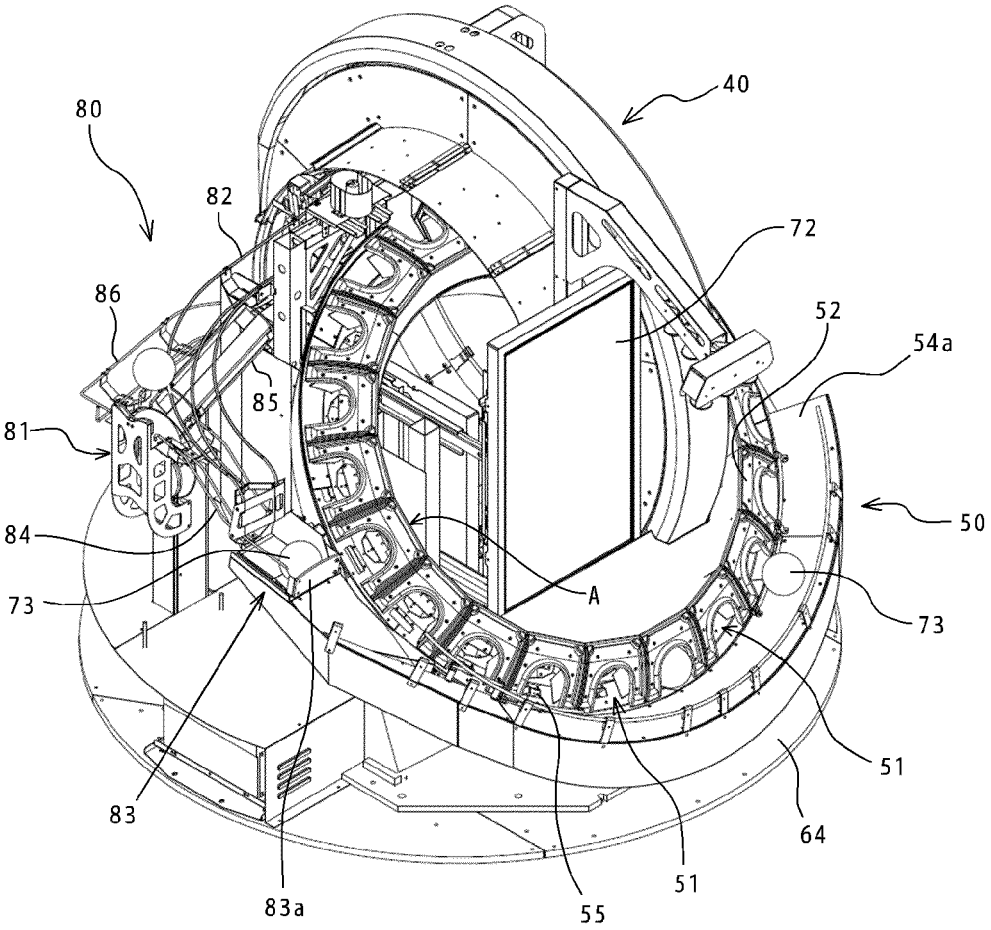
FIG. 7 is a perspective view when the center drawing apparatus is viewed from a different angle from that of FIG. 6.

FIG. 7 is a perspective view when the center drawing apparatus 3 is viewed from a different angle from that of FIG. 6.

The center drawing apparatus 3 of the present embodiment is constituted mainly with a vertical ring drawing device 40 serving as a first drawing mechanism for supporting these drawing devices 40, 50 from vertically below, an inclined ring drawing device 50 serving as a second drawing mechanism, a device supporting base 60, two display devices 71, 72 serving as display units functioning as display means, and a ball transfer device 80 that inserts a drawing ball 73 serving as a drawing object into each of the drawing devices 40, 50 and collects the drawing ball 73 from each of the drawing devices 40, 50. The first display device 71 is arranged so as to allow the player to perform visual recognition through a hollow region of the vertical ring drawing device 40, and the second display device 72 is arranged in its part inside of the hollow region of the inclined ring drawing device 50.

At an upper portion of the device supporting base 60, a rotary table 64 on which the vertical ring drawing device 40, the inclined ring drawing device 50, the two display devices 71, 72, the ball transfer device 80, and so on are placed is provided. This rotary table 64 can be rotated around a rotating shaft parallel to the vertical direction by a table driving device (not shown). Accordingly, it can be made, for the respective station units 2, so that the vertical ring drawing device 40 and the inclined ring drawing device 50 face the front thereof.

The vertical ring drawing device 40, as shown in FIG. 6, includes a body structure part that is configured, with its hollow region exposed in part to the outside, so as to surround the hollow region, and is arranged so that its rotating shaft becomes parallel with respect to the horizontal direction. At an inner peripheral surface of the vertical ring drawing device 40, a plurality of drawing pockets 41 each having an internal space to allow for accommodating only approximately one drawing ball 73 are formed throughout its circumferential direction. In the present embodiment, ten drawing pockets 41 are provided at equal intervals at the inner peripheral surface of the vertical ring drawing device 40. For the vertical ring drawing device 40, at a ring inner peripheral surface side of a framework base member 42 serving as a drawing pocket forming member, an inner peripheral surface member 43 formed with openings serving as entrances of the drawing pockets 41 is attached. Moreover, at a ring outer peripheral surface side of the framework base member 42, an outer peripheral surface member 44 fixed to the device supporting base 60 is arranged facing the same. The framework base member 42 and the inner peripheral surface member 43 of the vertical ring drawing device 40 are rotationally driven counterclockwise in FIG. 6 by a first driving device 61 provided on the device supporting base 60. Accordingly, the drawing pockets 41 of the vertical ring drawing device 40 rotationally move. Then, when the drawing ball 73 enters into any of the drawing pockets 41 of the vertical ring drawing device 40, the drawing ball 73 moves along with the drawing pocket 41 remaining accommodated in the drawing pocket 41.

When a mechanical drawing is performed by the vertical ring drawing device 40, the drawing ball 73 is dropped onto the inner peripheral surface of the vertical ring drawing device 40 from a ball drop-in opening 86*a*. In the present embodiment, the inner peripheral surface of the vertical ring drawing device 40 is roughly divided into two regions in its rotating shaft direction. That is, the two regions are a pocket region (region at the front side in FIG. 6) where drawing pockets 41 are provided and a non-pocket region (region at the back side in FIG. 6) where no drawing pockets 41 are provided. The pocket region and non-pocket region are divided by a plurality of projection walls 43*a* intermittently arranged throughout the entire circumference. A clearance formed between the projection walls 43*a* has a width to allow approximately one drawing ball 73 to pass therethrough.

The drawing ball 73 is dropped onto the non-pocket region of the inner peripheral surface of the vertical ring drawing device 40 from the ball drop-in opening 86*a*. The non-pocket region is formed so as to incline toward the pocket region at a lower position of the vertical ring drawing device 40. Accordingly, the drawing ball 73 on the non-pocket region receives a force to move toward the pocket region due to gravity. Since the drawing ball 73 immediately after being dropped has a large relative moving speed with respect to the projection walls 43*a*, the drawing ball 73 is restricted by the projection walls 43*a* to move in a reciprocating manner like a pendulum on the non-pocket region along the circumferential direction of the vertical ring drawing device 40 without being able to pass through the clearance between the projection walls 43*a*. Thereafter, when the force of the drawing ball 73 gradually abates, and the relative moving speed with respect to the projection walls 43*a* is reduced, the drawing ball 73 is enabled to pass through the clearance between the projection walls 43*a* due to the inclination of the non-pocket region, and moves to the pocket region side. On the pocket region, a plurality of projection portions 43*b* to prevent the drawing ball 73 from entering into the drawing pocket 41 are provided. The drawing ball 73 that has moved to the pocket region side is flicked by the projection portions 43*b* while drifting on the pocket region, and finally enters into any of the drawing pockets 41.

In the present embodiment, a part surrounding the drawing pockets 41 in the pocket region forms an inclined surface that inclines towards each of the drawing pockets 41. Accordingly, since it becomes easier for the drawing ball 73 rolling on the pocket region to enter into the drawing pocket 41, the mechanical drawing time (time until the drawing ball enters into the drawing pocket after being dropped-in) by the vertical ring drawing device 40 can be reduced, and control of the mechanical drawing time by adjusting the rotating speed of the vertical ring drawing device 40 becomes easy.

The drawing ball 73 that has entered into the drawing pocket 41 at a lower portion of the vertical ring drawing device 40 is transferred by rotary drive to an upper side of the vertical ring drawing device 40 with a rotational movement of the drawing pocket 41. At the upper side of the vertical ring drawing device 40, since the inner peripheral surface with the drawing pockets 41 provided faces vertically downward, the drawing ball 73 falls out of the drawing pocket 41 due to its own weight if remaining as is. In the present embodiment, as shown in FIG. 6, for prevention of this fall-out, fall-out preventing rails 47*a*, 47*b* (refer to FIG. 11) are provided so as to face the inner peripheral surface at an upper part of the vertical ring drawing device 40. Accordingly, there is provided a configuration where the drawing ball 73 transferred to the upper side of the vertical ring drawing device 40, which is supported by the fall-out preventing rails 47*a*, 47*b*, can rotationally move along the vertical ring drawing device 40 due to rotary drive.

On the other hand, the configuration of the inclined ring drawing device 50 is different from that of the foregoing vertical ring drawing device 40 in the point that its rotating shaft is inclined with respect to both of the vertical direction and horizontal direction and the point that entrances of the drawing pockets 51 are opened to an outer peripheral surface side, but has the same configuration as that of the vertical ring drawing device 40 in the point, as shown in FIG. 6 and FIG. 7, of having a body structure part that is configured, with its hollow region exposed in part to the outside so as to surround the hollow region. When described in detail, at an outer peripheral surface of the inclined ring drawing device 50, a plurality of drawing pockets 51 each having an internal space to allow for accommodating only approximately one drawing ball 73 are formed throughout its circumferential direction. In the present embodiment, twenty drawing pockets 51 are provided at equal intervals at the outer peripheral surface of the inclined ring drawing device 50. For the inclined ring drawing device 50, on a pedestal 54 fixed to a device supporting base 60, a partition member 52 serving as a drawing pocket forming member for partitioning the drawing pockets 51 from each other is provided. The partition member 52 of the inclined ring drawing device 50 is rotationally driven counterclockwise in the figure on the pedestal 54 by a driving device (not shown) provided on the device supporting base 60. Accordingly, the drawing pockets 51 of the vertical ring drawing device 50 rotationally move.

Figure 8:
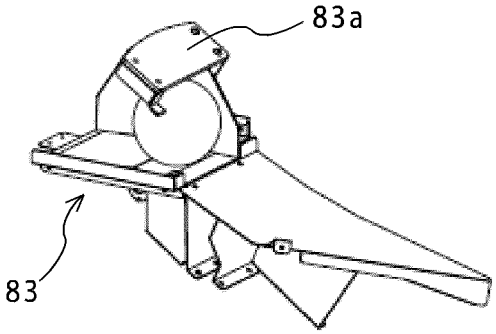
FIG. 8 is an explanatory view of a state when a shutter, which is provided in a ball drop-in standby unit 83 of a inclined ring drawing device in the center drawing apparatus, released a drawing ball.

The drawing ball 73 is temporarily retained by being blocked by a shutter 83*a* at a ball drop-in standby unit 83 as shown in FIG. 7, and then dropped onto a slope 54*a* of the inclined ring drawing device 50 as a result of the shutter 83*a* moving as shown in FIG. 8. The slope 54*a* is arranged so as to be adjacent to the partition member 52 at a lower position of the inclined ring drawing device 50, and formed so as to incline toward the partition member 52. Accordingly, the drawing ball 73 on the slope 54*a* receives a force to move toward the partition member 52 due to gravity. Since the drawing ball 73 immediately after being dropped has a large relative moving speed with respect to the drawing pockets 51 of the partition member 52, the drawing ball 73 moves in a reciprocating manner like a pendulum on the slope 54*a* along the circumferential direction of the inclined ring drawing device 50 without being able to enter into the drawing pocket 51. Thereafter, when the force of the drawing ball 73 gradually abates, and the relative moving speed with respect to the drawing pocket 51 is reduced, the drawing ball 73 is enabled to enter into the drawing pocket 51, and finally enters into any of the drawing pockets 51.

In the present embodiment, the vertical ring drawing device 40 and the inclined ring drawing device 50 are arranged so that part of each other's drawing device is located in the other's hollow region. In greater detail, in the present embodiment, the drawing devices 40, 50 are arranged so that the two drawing devices 40, 50 are mutually connected like a chain. Generally, in a configuration, such as the vertical ring drawing device 40 or the inclined ring drawing device 50, having a hollow region, its hollow region is likely to become a dead space, and a mechanical drawing machine including such a configuration is likely to be increased in size. Particularly, when two or more drawing devices having hollow regions exist as in the present embodiment, a plurality of dead spaces can exist, and thus the mechanical drawing machine is more likely to be increased in size. In the present embodiment, by putting each other's body structure parts into the dead spaces of the drawing devices 40, 50, each other's dead spaces are canceled out. Accordingly, even when two or more drawing devices having hollow regions exist, it can be suppressed to increase the mechanical drawing machine (center drawing apparatus 3) in size unnecessarily, so that a mechanical drawing machine with a compact structure can be realized.

Although, in the present embodiment, a description has been given for an example of the case where two mechanical drawing mechanisms including hollow regions are provided, three or more mechanical drawing mechanisms may be provided. When three or more mechanical drawing mechanisms are provided, two or more body structure parts may be joined together to one body structure part.

Moreover, in the present embodiment, the vertical ring drawing device 40 and the inclined ring drawing device 50 are different from each other in the inclination angle (angle created by the vertical direction and the rotating shaft) of their rotating shafts, these may be configured so as to have mutually equal inclination angles. The inclination angle of the rotating shaft of each mechanical drawing machine can be arbitrarily set.

Moreover, the vertical ring drawing device 40 and the inclined ring drawing device 50 in the present embodiment are both in doughnut shapes where the body structure part has a closed loop, but may be in U-shapes or C-shapes where the loop of the body structure part is partially open.

Figure 9:
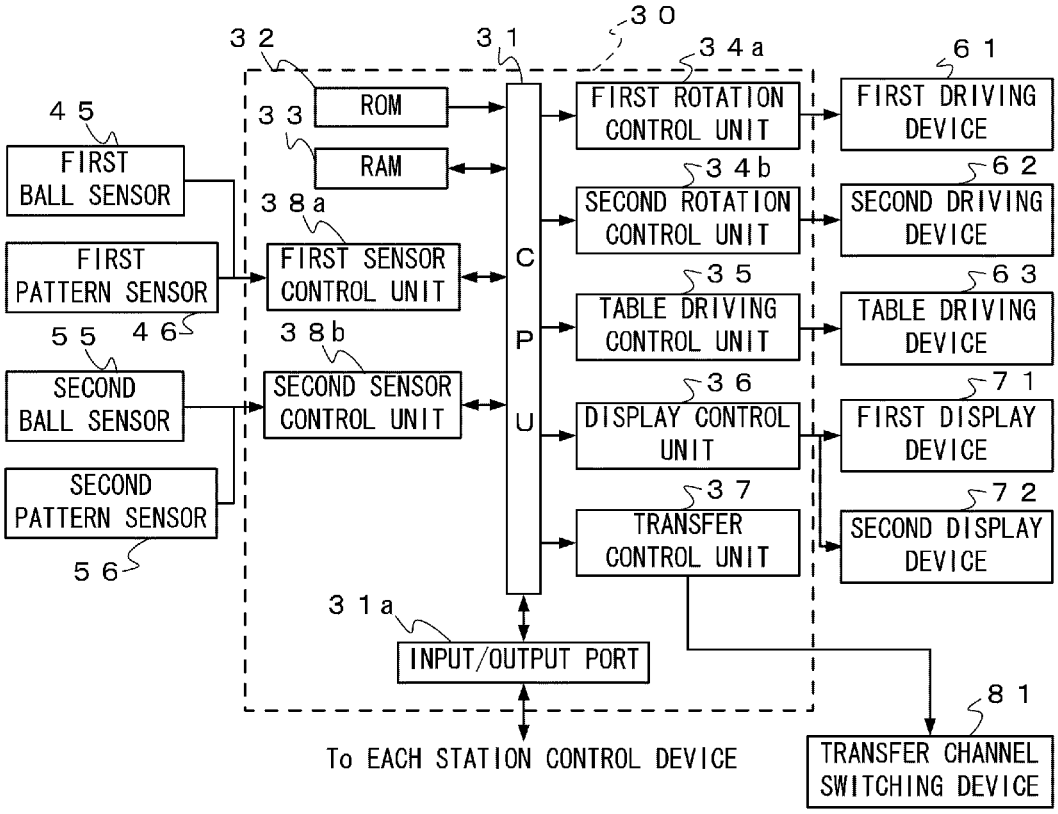
FIG. 9 is a block diagram showing a schematic configuration of the main part of the central control device that controls the center drawing apparatus.

FIG. 9 is a block diagram showing a schematic configuration of the main part of a central control device 30 that controls the center drawing apparatus 3.

The central control device 30 is constituted with a CPU 31, an input/output port 31*a*, a ROM 32, a RAM 33, a first rotation control unit 34*a*, a second rotation control unit 34*b*, a table driving control unit 35, a display control unit 36, a transfer control unit 37, a first sensor control unit 38*a* serving as a pocket identifying unit functioning as pocket identifying means, a second sensor control unit 38*b* serving as a pocket identifying unit functioning as pocket identifying means, and so on. The input/output port 31*a* is used for performing data communications with each station control device 20. The ROM 32 stores data such as various types of programs and various types of databases to be used by the CPU 31, and outputs these to the CPU 31. The RAM 33 temporarily stores variable data calculated by the CPU 31 and the like or stores various types of varying data such as a jackpot retention count. The first rotation control unit 34*a*, under the control of the CPU 31, controls the first driving device 61 serving as a driving unit functioning as driving means that rotationally drives the vertical ring drawing device 40. The second rotation control unit 34*b*, under the control of the CPU 31, controls the second driving device 62 serving as a driving unit functioning as driving means that rotationally drives the inclined ring drawing device 50. The table driving control unit 35, under the control of the CPU 31, controls a table driving device 63 that rotationally drives the rotary table 64. The display control unit 36 constitutes a display unit in cooperation with the first display device 71 for the vertical ring drawing device 40 and the second display device 72 for the inclined ring drawing device 50, and under the control of the CPU 31, performs display control of these display devices 71, 72 that displays a screen for explanation of the drawing or performances and the like. The transfer control unit 37, under the control of the CPU 31, controls various driving devices such as a transfer channel switching mechanism present in the ball transfer device 80. The first sensor control unit 38*a*, according to output signals from a first ball sensor 45 serving as an object detecting unit functioning as object detecting means to be described later provided in the vertical ring drawing device 40 and a first pattern sensor 46 serving as a mark content reading unit functioning as mark content reading means, outputs a winning pocket signal corresponding to the drawing pocket 41 into which the drawing ball 73 has entered to the CPU 31. The second sensor control unit 38*b*, according to output signals from a second ball sensor 55 serving as an object detecting unit functioning as object detecting means to be described later provided in the inclined ring drawing device 50 and a second pattern sensor 56 serving as a mark content reading unit functioning as mark content reading means, outputs a winning pocket signal corresponding to the drawing pocket 51 into which the drawing ball 73 has entered to the CPU 31.

Figure 10:
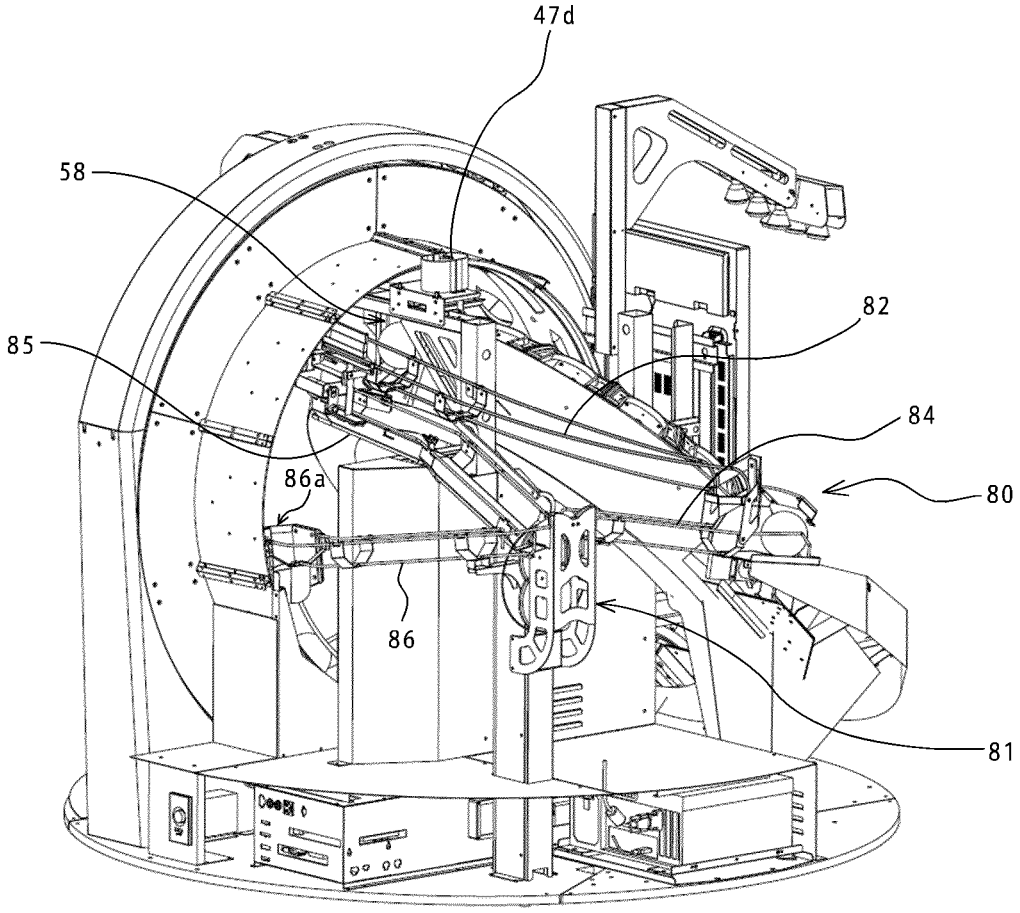
FIG. 10 is a perspective view showing an overall configuration of a ball transfer device in the center drawing apparatus.

FIG. 10 is a perspective view showing an overall configuration of the ball transfer device 80 to be connected to a ball discharge unit provided in each of the vertical ring drawing device 40 and the inclined ring drawing device 50.

Figure 11:
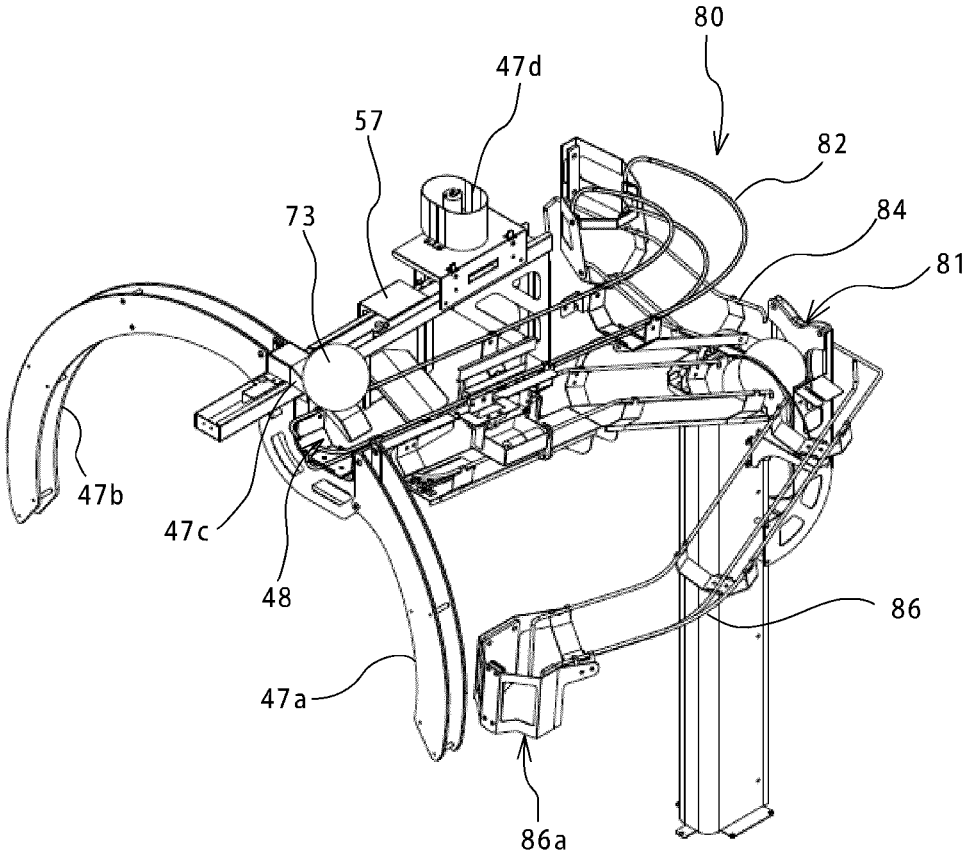
FIG. 11 is a perspective view for explaining the ball transfer device and its peripheral configuration.

FIG. 11 is a perspective view for explaining the ball transfer device 80 and its peripheral configuration.

Figure 12:
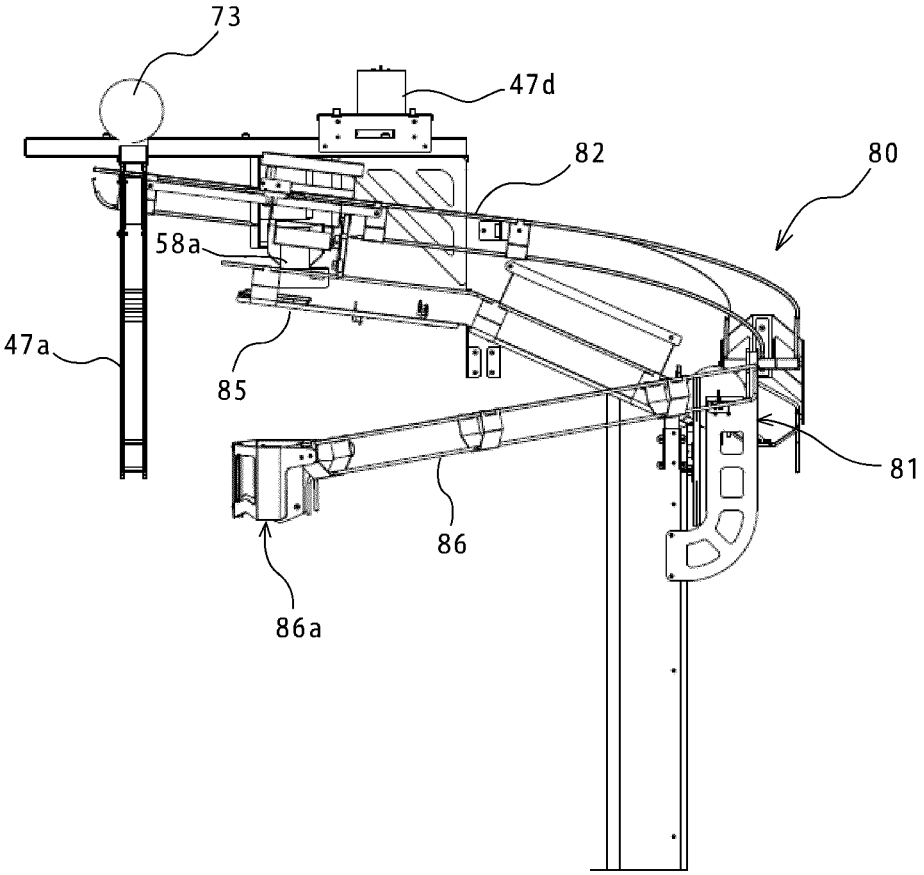
FIG. 12 is a side view for explaining the ball transfer device and its peripheral configuration.

FIG. 12 is a side view for explaining the ball transfer device 80 and its peripheral configuration.

First, description will be given of the configuration of the ball transfer device 80 along a transfer channel of the drawing ball 73 to be discharged from the ball discharge unit of the vertical ring drawing device 40.

In the present embodiment, as described above, at an upper part of the vertical ring drawing device 40, the fall-out preventing rails 47*a*, 47*b* to prevent the drawing ball 73 that rotationally moves remaining in the drawing pocket 41 from falling out of the drawing pocket 41 are provided. These fall-out preventing rails 47*a*, 47*b* have, as shown in FIG. 11, two divided parts in their circumferential direction, and a gap that allows the drawing ball 73 to pass therethrough is formed therebetween. This gap functions as a ball discharge unit (hereinafter, referred to as a "first ball discharge unit") 48 of the vertical ring drawing device 40. That is, the drawing ball 73 transferred by rotary drive of the vertical ring drawing device 40, when having reached a position to face the first ball discharge unit 48, falls downward due to its own weight through the first ball discharge unit 48.

Figure 13:
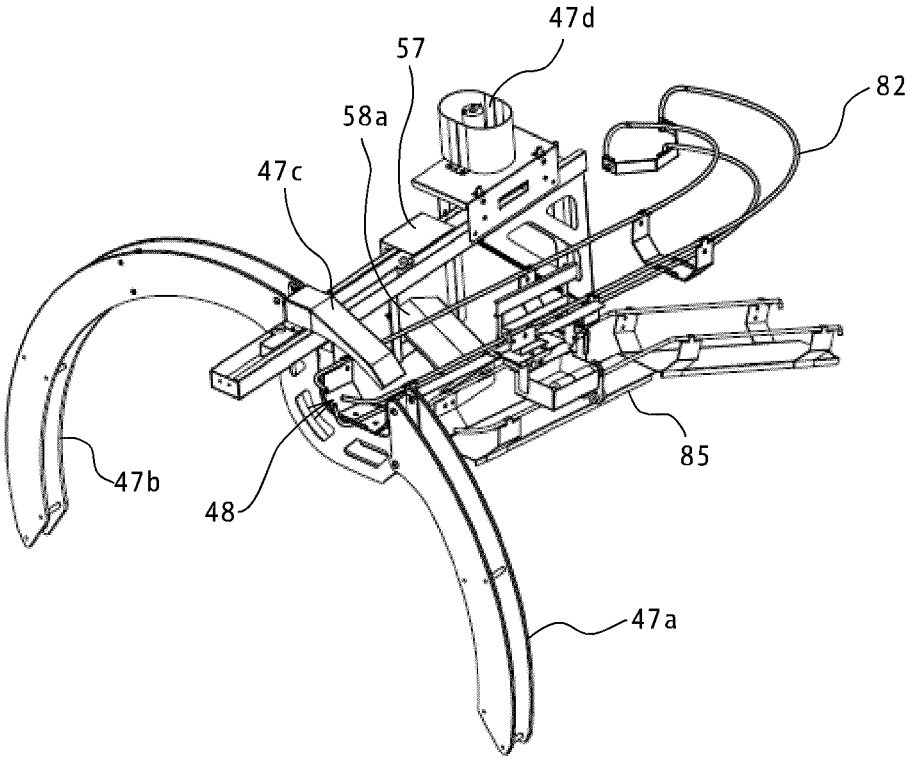
FIG. 13 is an explanatory view of a state when a shutter, which is provided in a first ball discharge unit of a vertical ring drawing device, moved to a ball passing position.
Figure 14:
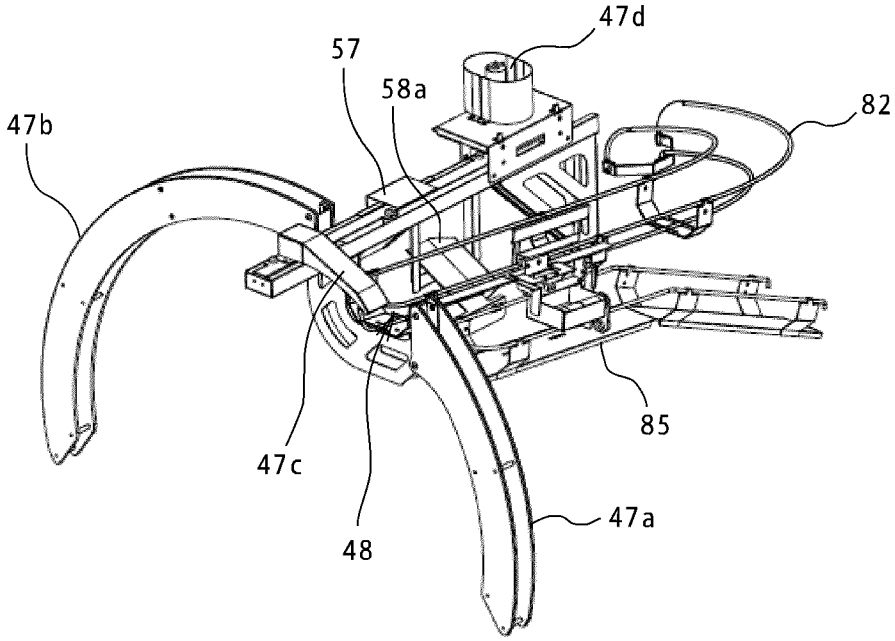
FIG. 14 is an explanatory view of a state when the shutter moved to a ball discharging position.

Moreover, on the first ball discharge unit 48, a shutter 47*c* serving as a discharge switching unit functioning as discharge switching means to take a discharging state or non-discharging state to or not to discharge the drawing ball 73 from the first ball discharge unit 48 is provided. This shutter 47*c* can be moved to a ball passing position shown in FIG. 13 to block the first ball discharge unit 48 and a ball discharging position shown in FIG. 14 to open the first ball discharge unit 48 by a driving device 47*d* that is controlled by the transfer control unit 37 of the central control device 30. When the drawing ball 73 passes through the first ball discharge unit 48 when the shutter 47*c* is located at the ball passing position as shown in FIG. 13, the drawing ball 73 does not fall from the first ball discharge unit 48, and rotationally moves another round around the vertical ring drawing device 40 remaining in the drawing pocket 41. On the other hand, when the drawing ball 73 passes through the first ball discharge unit 48 when the shutter 47*c* is located at the ball discharging position as shown in FIG. 14, the drawing ball 73 falls from the first ball discharge unit 48. Thus, in the present embodiment, it can be selectively executed, by controlling the operation of the shutter 47*c*, whether to discharge the drawing ball 73 that has entered into the drawing pocket 41 from the first ball discharge unit 48 or pass the drawing ball 73 through the first ball discharge unit 48 without discharging, and make the drawing ball 73 rotationally move another round around the vertical ring drawing device 40.

Below the first ball discharge unit 48, an upper end portion of a first transfer rail 82 of the ball transfer device 80 is arranged. This first transfer rail 82 is, as shown in FIG. 12, gently inclined, and its lower end portion is open. Below the lower end portion of the first transfer rail 82, a second transfer rail 84 that is inclined toward the ball drop-in standby unit 83 to transfer the drawing ball 73 by its own weight from the transfer channel switching device 81 to the ball drop-in standby unit 83 of the inclined ring drawing device 50 is arranged. Therefore, when the drawing ball 73 transferred along the first transfer rail 82 falls from the lower end portion of the first transfer rail 82, the drawing ball 73 is received by the second transfer rail 84, and transferred along the second transfer rail 84 to the ball drop-in standby unit 83 of the inclined ring drawing device 50.

Figure 15:
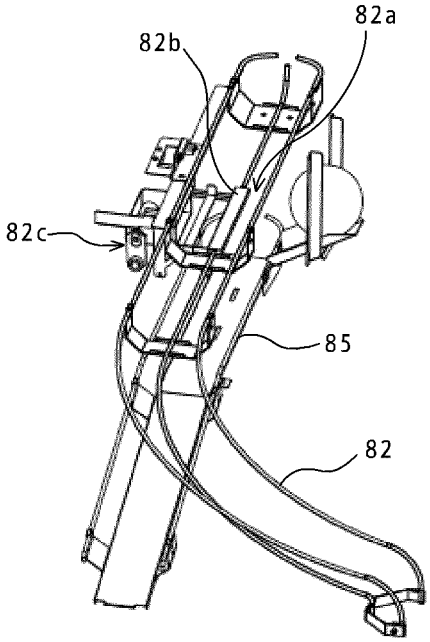
FIG. 15 is an explanatory view of a state when a shutter, which is provided at fall opening in the middle of a first transfer rail, moved to a blocking position.
Figure 16:
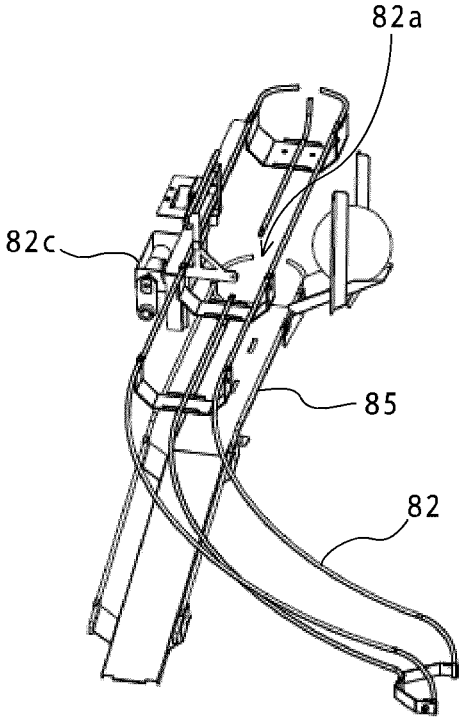
FIG. 16 is an explanatory view of a state when the shutter moved to a opening position.

In the middle of the first transfer rail 82, as shown in FIG. 15 and FIG. 16, a fall opening 82*a* which allows the drawing ball 73 to pass therethrough is formed. On this fall opening 82*a*, a shutter 82*b* that takes a discharging state or non-discharging state to or not to discharge the drawing ball 73 from the fall opening 82*a* is provided. This shutter 82*b* can be moved to a blocking position shown in FIG. 15 to block the fall opening 82*a* and an opening position shown in FIG. 16 to open the fall opening 82*a* by a driving device 82*c* that is controlled by the transfer control unit 37 of the central control device 30. When the drawing ball 73 passes through the fall opening 82*a* when the shutter 82*b* is located at the blocking position as shown in FIG. 15, the drawing ball 73 does not fall from the fall opening 82*a*, and is transferred to the lower end portion of the first transfer rail 82. On the other hand, when the drawing ball 73 passes through the fall opening 82*a* when the shutter 82*b* is located at the opening position as shown in FIG. 16, the drawing ball 73 falls from the fall opening 82*a*.

Below the fall opening 82*a* of the first transfer rail 82, an upper end portion of a third transfer rail 85 of the ball transfer device 80 is arranged. This third transfer rail 85 is gently inclined as shown in FIG. 12, and its lower end portion is connected to an entrance of the transfer channel switching device 81. Here, in the present embodiment, by driving control of the transfer channel switching device 81 as to be described later, the drawing ball 73 is supplied to the vertical ring drawing device 40 or the inclined ring drawing device 50, which enables a mechanical drawing using the drawing ball 73 in the vertical ring drawing device 40 or the inclined ring drawing device 50. Then, the drawing balls 73 to be supplied to the vertical ring drawing device 40 or the inclined ring drawing device 50 are retained side by side in a lower end-side part of the third transfer rail 85 connected to the entrance side of the transfer channel switching device 81. That is, in the present embodiment, the lower end-side part of the third transfer rail 85 and the transfer channel switching device 81 constitute a ball retaining unit.

Therefore, in the present embodiment, it can be selectively executed, by controlling the operation of the shutter 82*b*, whether to send the drawing ball 73 discharged from the first ball discharge unit 48 to the ball drop-in standby unit 83 of the inclined ring drawing device 50 or to the ball retaining unit.

Next, description will be given of the configuration of the ball transfer device 80 along a transfer channel of the drawing ball 73 to be discharged from the ball discharge unit of the inclined ring drawing device 50.

In the present embodiment, as described above, on a rotational movement channel of the drawing pockets 51 in the pedestal 54 of the inclined ring drawing device 50, a notch portion that allows the drawing ball 73 to pass therethrough is formed. This notch portion functions as a ball discharge unit (hereinafter, referred to as a "second ball discharge unit") 58 of the inclined ring drawing device 50. That is, the drawing ball 73 transferred by rotary drive of the inclined ring drawing device 50, when having reached a position to face the second ball discharge unit 58, is discharged due to its own weight through the second ball discharge unit 58, as shown in FIG. 10.

Moreover, on the second ball discharge unit 58, in the same manner as the first ball discharge unit 48 of the vertical ring drawing device 40, a shutter 57 serving as a discharge switching unit functioning as discharge switching means to take a discharging state or non-discharging state to or not to discharge the drawing ball 73 from the second ball discharge unit 58 is provided. This shutter 57 is driven by the driving device 47*d* to operate integrally with the shutter 47*c* of the vertical ring drawing device 40 and can be moved to a ball passing position shown in FIG. 13 to block the second ball discharge unit 58 and a ball discharging position shown in FIG. 14 to open the second ball discharge unit 58. When the drawing ball 73 passes through the second ball discharge unit 58 when this shutter 57 is located at the ball passing position as shown in FIG. 13, the drawing ball 73 does not fall from the second ball discharge unit 58, and rotationally moves another round around the inclined ring drawing device 50 remaining in the drawing pocket 51. On the other hand, when the drawing ball 73 passes through the second ball discharge unit 58 when the shutter 57 is located at the ball discharging position as shown in FIG. 14, the drawing ball 73 falls from the second ball discharge unit 58. Thus, in the present embodiment, it can be selectively executed, by controlling the operation of the shutter 57, whether to discharge the drawing ball 73 that has entered into the drawing pocket 51 from the second ball discharge unit 58 or pass the discharge ball 73 through the second ball discharge unit 58 without discharging, and make the drawing ball 73 rotationally move another round around the inclined ring drawing device 50.

The drawing ball 73 to be discharged from the second ball discharge unit 58 is, by a discharge slope 58*a*, guided to the upper end portion of the foregoing third transfer rail 85 of the ball transfer device 80. Therefore, the drawing ball 73 discharged from the second ball discharge unit 58 is transferred by the third transfer rail 85 to the entrance of the transfer channel switching device 81, that is, the ball retaining unit.

Figure 17:
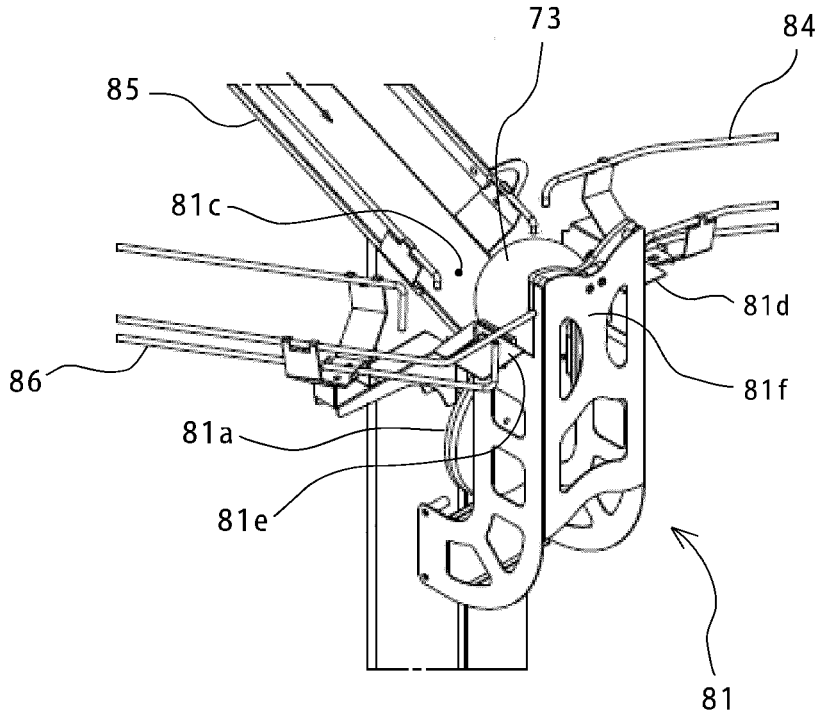
FIG. 17 is an explanatory view of a transfer channel switching device in the ball transfer device when the transfer channel switching device is in a standby state.
Figure 18:
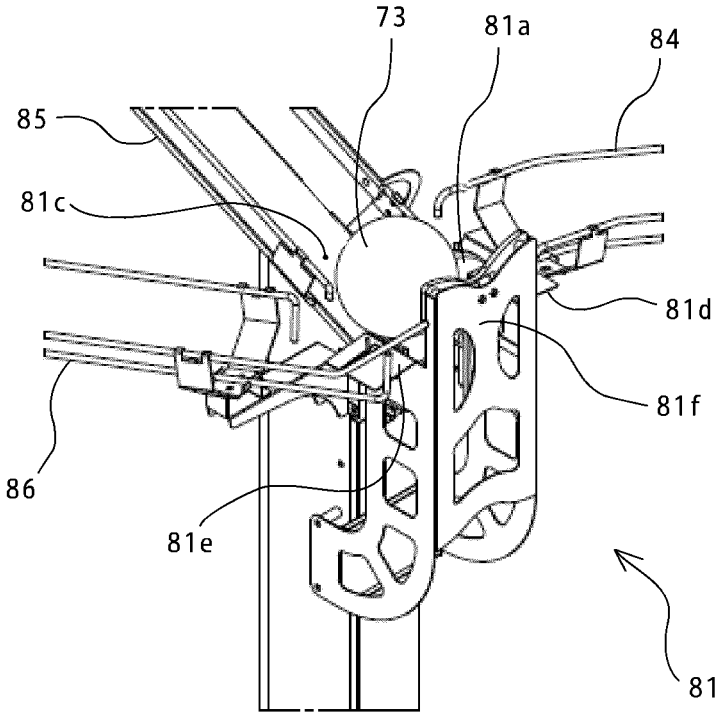
FIG. 18 is an explanatory view of the transfer channel switching device when the drawing ball is transferred to a first exit.
Figure 19:
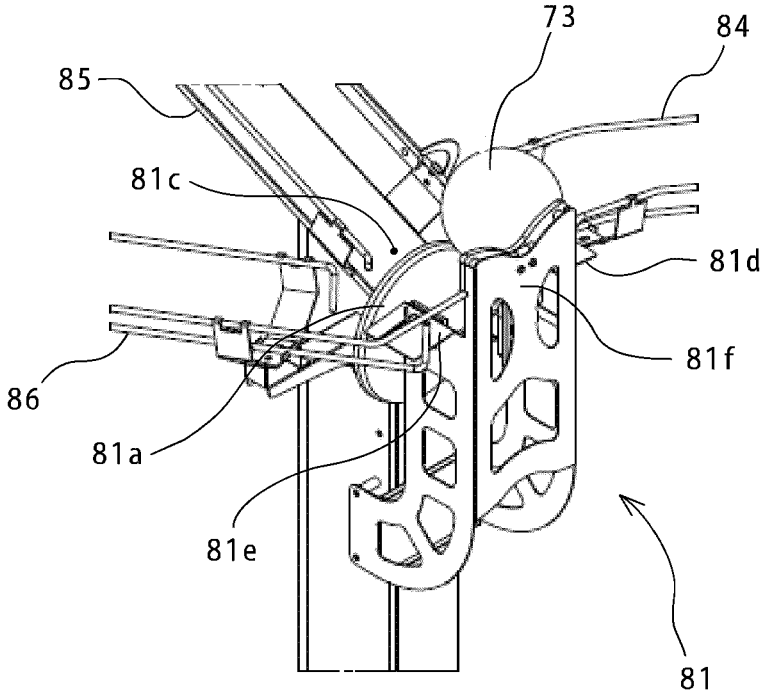
FIG. 19 is an explanatory view of the transfer channel switching device when the drawing ball is transferred to a second exit.

FIG. 17, FIG. 18, and FIG. 19 are views for explaining a schematic configuration and operation of the transfer channel switching device 81.

The transfer channel switching device 81 is constituted mainly with an eccentric rotating member 81*a* and a drive motor (not shown) that rotates the eccentric rotating member 81*a*. The eccentric rotating member 81*a* is constituted with a disk-like member, and the drive motor is connected to a rotating shaft provided at an eccentric position deviated from it's disk center. The drive motor is controlled in its rotating direction and rotating angle by the transfer control unit 37 of the central control device 30. In the present embodiment, the eccentric rotating member 81*a* stops, in a standby state, as shown in FIG. 17, with its longer radius side-end portion farthest from the rotating shaft of the eccentric rotating member 81*a* facing vertically directly down. In this standby state, the drawing ball 73 located at the most downstream side out of the drawing balls 73 retained side by side in the lower end-side part of the third transfer rail 85 connected to the entrance of the transfer channel switching device 81 enters into the transfer channel switching device 81 as shown in FIG. 17. At this time, the drawing ball 73 at the most downstream side is positioned vertically above the eccentric rotating member 81*a*.

In the transfer channel switching device 81, there are provided two exits of a first exit connected to an upper end portion of a fourth transfer rail 86 inclined toward a ball drop-in position of the vertical ring drawing device 40 and a second exit connected to the upper end portion of the second transfer rail 84 inclined toward the ball drop-in standby unit 83 of the inclined ring drawing device 50. Bottom surfaces of these exits are each located at a position higher than a lower position of the drawing ball 73 positioned inside of the transfer channel switching device 81 in the standby state. Therefore, in the standby state, when the drawing ball 73 enters into the transfer channel switching device 81, a member 81*c* that forms a bottom portion of the entrance, members 81*d*, 81*e* that form the bottom surfaces of the first exit and second exit, respectively, and a wall surface member 81*f* that is provided at a side portion facing the entrance are in contact with four-way side portions of the drawing ball 73, and the drawing ball 73 is placed in a state restricted from rolling, and held without exiting from the exit of the transfer channel switching device 81.

Thereafter, when the drive motor rotationally drives counterclockwise in the figure, the longer radius side-end portion of the eccentric rotating member 81*a* rotates vertically upward as shown in FIG. 18. Accordingly, a peripheral part facing in the rotating direction of the eccentric rotating member 81*a* gradually pushes up the drawing ball 73 from a lower side of the drawing ball 73 to the side of the first exit connected to the upper end portion of the fourth transfer rail 86. Then, around the time that the longer radius side-end portion of the eccentric rotating member 81*a* faces vertically directly up, the drawing ball 73 is pushed out toward the fourth transfer rail 86 as well as lifted by the peripheral part of the eccentric rotating member 81*a* to the height of the first exit, and the drawing ball 73 is transferred from the first exit through the fourth transfer rail 86 to the ball drop-in position of the vertical ring drawing device 40.

Similarly, as a result of control from the transfer control unit 37, when the drive motor rotationally drives clockwise in the figure, the longer radius side-end portion of the eccentric rotating member 81*a* rotates vertically upward, as shown in FIG. 19. Accordingly, a peripheral part facing in the rotating direction of the eccentric rotating member 81*a* gradually pushes up the drawing ball 73 from a lower side of the drawing ball 73 to the side of the second exit connected to the upper end portion of the second transfer rail 84. Then, around the time that the longer radius side-end portion of the eccentric rotating member 81*a* faces vertically directly up, the drawing ball 73 is pushed out toward the second transfer rail 84 as well as lifted by the peripheral part of the eccentric rotating member 81*a* to the height of the second exit, and the drawing ball 73 is transferred from the second exit through the second transfer rail 84 to the ball drop-in standby unit 83 of the inclined ring drawing device 50.

Next, description will be given of a configuration and operation for detecting which of the drawing pockets 41, 51 the drawing ball 73 has entered into.

In the present embodiment, since the configuration and operation relating to this detection is almost the same between the vertical ring drawing device 40 and the inclined ring drawing device 50, in the following description, the inclined ring drawing device 50 will be described as an example, and description of the vertical ring drawing device 40 will be omitted.

Figure 20:
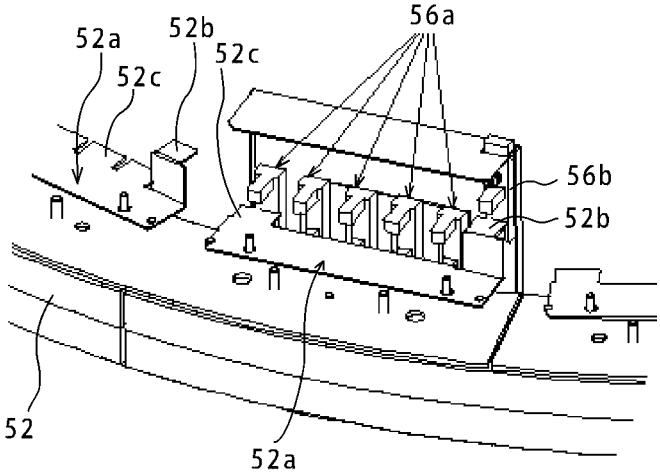
FIG. 20 is a perspective view showing a configuration of a second pattern sensor provided in the inclined ring drawing device.

FIG. 20 is a perspective view showing a configuration of the second pattern sensor 56 provided in the inclined ring drawing device 50.

In the present embodiment, as described above, the partition member 52 serving as a drawing pocket forming member that forms the drawing pockets 51 is driven so as to rotationally move, in order to rotationally move the drawing pockets 51. On the other hand, the central control device 30 is fixedly arranged inside of the device supporting base 60 serving as a stationary base. Therefore, if a sensor for detecting that the drawing ball 73 has entered into each drawing pocket 51 is provided on the partition member 52 so as to rotationally move together with the drawing pocket 51, it is difficult to transmit an output signal of the sensor stably to the central control device 30.

Therefore, in the present embodiment, a configuration is adopted for detecting which of the rotationally moving drawing pockets the drawing ball 73 has entered into by using only a sensor that is fixedly arranged.

When described in detail, as shown in FIG. 7, the second ball sensors 55 are fixedly arranged at a lower part of the inclined ring drawing device 50 and a part of the pedestal 54 through which the drawing pockets 51 pass. In the present embodiment, a total of seven second ball sensors 55 of one at the lowermost portion of a rotational movement channel of the drawing pockets 51 and three each on both circumferential sides thereof are dispersedly arranged separated at intervals the same as circumferential intervals between the drawing pockets 51. The seven second ball sensors 55 are all sensors constituted with mechanical switches, and by the drawing ball 73 that has entered into any of the drawing pockets 51 pushing down by its own weight a switch piece of the second ball sensor 55 through which the drawing ball 73 is first to pass, the drawing ball 73 is detected by said second ball sensor 55.

Here, an output signal (ball detection signal) alone of the second ball sensor 55 is not enough to identify which of the drawing pockets 51 the drawing ball 73 has entered into. Therefore, which of the drawing pockets 51 the drawing ball 73 has entered into is identified by using not only a ball detection signal of the second ball sensor 55 but also an output signal (pattern signal) of the second pattern sensor 56 shown in FIG. 20.

The second pattern sensor 56 is fixedly arranged at an inner peripheral surface side of the inclined ring drawing device 50 and a part (part shown by the symbol A in FIG. 7) facing the ball drop-in standby unit 83. This second pattern sensor 56 reads mark patterns of mark plates 52*a* serving as mark forming and moving members of the same number as that of drawing pockets 51 and provided at an inner peripheral surface of the partition member 52 so as to be at equal intervals to each other. Each mark plate 52*a* includes one trigger piece 52*b* and at most five mark pieces 52*c*, and mutually different mark patterns (mark contents) are formed by combination of the presence and absence of the mark pieces 52*c*. The second pattern sensor 56 is constituted with five mark sensors 56*a* serving as mark piece detecting sensors for detecting the mark pieces 52*c* of the mark plate 52*a* and one trigger sensor 56*b* to detect the trigger piece 52*b* of the mark plate 52*a*. The mark sensors 56*a* and the trigger sensor 56*b* are all transmissive optical sensors, and perform detection based on whether an optical path is interrupted by the mark pieces 52*c* and the trigger piece 52*b*.

The second pattern sensor 56, every time the trigger piece 52*b* is detected by the trigger sensor 56*b*, outputs a pattern signal indicating a combination of output signals of the five mark sensors 56*a* at that detection to the second sensor control unit 38*b* of the central control device 30. It is assumed that the drawing ball 73 has entered into the drawing pocket 51, and this has been detected by the second ball sensor 55 (second ball sensor 55 at the center in the circumferential direction) located at the lowermost portion among the seven second ball sensors 55. In this case, a ball detection signal is output from that second ball sensor 55, and this ball detection signal is input to the second sensor control unit 38*b* of the central control device 30. The second sensor control unit 38*b* that has received the ball detection signal, by being input with a pattern signal from the second pattern sensor 56 simultaneously with or immediately after that reception, identifies the drawing pocket 51 corresponding to that pattern signal as a drawing pocket into which the drawing ball 73 has entered.

That is, the positional relationship between the second pattern sensor 56 and the second ball sensor 55 located at the lowermost portion is fixed. Concretely, when the drawing pocket 51 into which the drawing ball has entered is located at a facing position with the second ball sensor 55, the mark pattern of the mark plate 52*a* provided at the inner peripheral surface side of a drawing pocket shifted with respect to that drawing pocket 51 by five pockets to the downstream side in the rotational movement direction of the drawing pockets is detected by the second pattern sensor 56. Therefore, when the drawing ball 73 is detected by the second ball sensor 55 located at the lowermost portion, the mark pattern of the mark plate 52*a* detected by the second pattern sensor 56 corresponds to a drawing pocket shifted with respect to the drawing pocket 51 arranged at a facing position of that mark plate 52*a* by five pockets to the upstream side in the rotational movement direction of the drawing pockets. Accordingly, the second sensor control unit 38*b* that has received a ball detection signal from the lowermost second ball sensor 55, by receiving a pattern signal from the second pattern sensor 56 simultaneously with or immediately after that reception, can identify a drawing pocket into which the drawing ball 73 has entered, for example, with reference to a data table indicating their correspondence. Then, the second sensor control unit 38*b* outputs a winning pocket signal indicating the identified drawing pocket to the CPU 31.

Here, in the present embodiment, there are provided seven second ball sensors 55, and the positional relationships between the second ball sensors 55 and the second pattern sensor 56 are different from each other. Therefore, the correspondence between a pattern signal from the second pattern sensor 56 and a drawing pocket into which the drawing ball 73 has entered differs from one second ball sensor 55 to detect the drawing ball 73 to another. Concretely, for example, a mark pattern read by the second pattern sensor 56 when the second ball sensor 55 arranged at the most upstream side in the rotational movement direction of the drawing pockets has detected the drawing ball 73 corresponds to a drawing pocket shifted with respect to the drawing pocket 51 arranged at a facing position of its mark plate 52*a* by eight pockets to the upstream side in the rotational movement direction of the drawing pockets. Further, for example, a mark pattern read by the second pattern sensor 56 when the second ball sensor 55 arranged at the most downstream side in the rotational movement direction of the drawing pockets has detected the drawing ball 73 corresponds to a drawing pocket shifted with respect to the drawing pocket 51 arranged at a facing position of its mark plate 52*a* by two pockets to the upstream side in the rotational movement direction of the drawing pockets.

Although it suffices to provide at least one second ball sensor 55, the reasons that a plurality of second ball sensors 55 are provided in the present embodiment are as follows.

First, this is for identifying the drawing pocket 51 at a timing as early as possible from the point in time where the drawing ball 73 has entered into that drawing pocket. That is, in the present embodiment, the drawing ball 73 does not always enter into the lowermost drawing pocket, and can enter into any of the drawing pockets 51 in a range of a total of five drawing pockets (accessible region) of two drawing pockets each on both sides of the lowermost drawing pocket. In this case, by providing one second ball sensor 55 only near the most downstream side in the rotational movement direction of the drawing pockets within this range, the drawing pocket into which the drawing ball 73 has entered can be identified. However, in this case, after the drawing ball 73 enters into the drawing pocket 51, that drawing pocket 51 cannot be identified until the drawing pocket 51 moves to the position of the second ball sensor 55. Therefore, the drawing pocket 51 cannot be identified for a while after the drawing ball 73 entered into that drawing pocket 53, which can cause adverse effects such as a delay in a performance. To cope therewith, by providing a plurality of second ball sensors 55 as in the present embodiment, the maximum delay time after the drawing ball 73 enters into the drawing pocket 51 until this is detected can be reduced. Accordingly, the drawing pocket 51 can be identified at an early timing from the point in time where the drawing ball 73 has entered into that drawing pocket 51, so that the adverse effects such as a delay in a performance can be reduced.

Second, this is for allowing to continue the game progress (mechanical drawing) without downtime even when, for example, detection becomes unstable due to malfunction of the second ball sensor 55, deterioration with age in push-in of the switch piece of the second ball sensor 55 by the drawing ball 73, and the like. That is, providing a plurality of second ball sensors 55 as in the present embodiment allows ball detection by the next second ball sensor 55 even in the case of failure in detection by the second ball sensor 55 that reaches immediately after the drawing ball 73 has entered into the drawing pocket 51, thereby allowing continuing the game progress (mechanical drawing) without downtime.

Moreover, in the present embodiment, a second ball sensor 55 is also arranged outside of the accessible region on the downstream side in the rotational movement direction of the drawing pockets with respect to the range (accessible region) of five drawing pockets into which the drawing ball 73 can enter. Accordingly, even in the case of failure in detection by the second ball sensor 55 arranged inside of the accessible region, the drawing ball can be detected by the second ball sensor 55 outside of the accessible region. Without such a second ball sensor 55 outside of the accessible region, in the case of failure in detection by the second ball sensor 55 arranged inside of the accessible region, the drawing pocket 51 into which the drawing ball 73 has entered cannot be identified until that drawing pocket 51 makes approximately one round to again reach the accessible region and is detected by the second ball sensor 55 inside of the accessible region. This prolongs the time after the drawing ball 73 enters into the drawing pocket 51 until that drawing pocket 51 is identified, which brings about a largely unpleasant feeling for the drawer, causing a situation in which the fun of the mechanical drawing is reduced. According to the present embodiment, the occurrence of such a situation can be prevented.

In the case of a constitution where the rotating direction of the drawing pocket 51 can be switched to both forward and reverse directions, by arranging the second ball sensors 55 outside of the accessible region in a manner sandwiching the accessible region, the occurrence of such a situation as described above can be prevented in either case where the drawing pocket 51 is rotated in the forward or reverse direction.

Although, in the present embodiment, a description has been given for the case where the second control unit 38*b* that has received a ball detection signal identifies the drawing pocket into which the drawing ball 73 has entered based on a pattern signal received simultaneously with or immediately after that reception, another method may be adopted. For example, a method of the second sensor control unit 38*b* always storing the latest pattern signal, for identifying a drawing pocket into which the drawing ball 73 has entered based on the latest pattern signal stored therein when having received a ball detection signal may be adopted. This method is excellent in the point that the drawing pocket 51 can be identified at an earlier timing.

In the present embodiment, the constitution where the mark plate 52*a* rotationally moves with the same period as that of the drawing pocket 51 in conjunction with a movement of the partition member 52 has been realized by fixing the mark plates 52*a* to the partition member 52, but this can also be realized by another constitution. For example, the mark plates 52*a* may be provided on a rotor that rotates in conjunction with a movement of the partition member 52. In this case, mark pattern detection of the mark plate 52*a* can be performed in a place separated from the partition member 52, so that the degree of freedom of layout is increased.

In the present embodiment, marks that are different from one drawing pocket 51 to another are composed of the mark plates 52*a* that are different in combination of the presence and absence of the mark pieces 52*c* from each other, but another constitution may also be adopted. For example, as the marks that are different from one drawing pocket 51 to another, mark plates formed with barcodes that are different from one drawing pocket 51 to another may also be adopted. In this case, their barcode information is read by a barcode sensor. In addition, as the marks that are different from one drawing pocket 51 to another, storage units such as non-contact ICs in which electronic data that is different from one drawing pocket 51 to another is stored may be adopted. In this case, the electronic data is read by a reading device capable of reading in a non-contact state the electronic data stored in the storage units.

Moreover, in the present embodiment, a description has been given for the case of providing mark plates 52*a* corresponding to the drawing pockets 51, respectively, for identifying the drawing pocket 51 based on the mark patterns of the mark plates 52*a*, but the drawing pocket 51 may also be identified by another method. For example, there is provided a constitution of providing, in a manner such as fixing to the partition member 52, one mark that rotationally moves with the same period as that of a rotational movement of the drawing pocket 51 in conjunction with a movement of the partition member 52, and detecting this mark by a mark sensor serving as a mark detecting unit functioning as mark detecting means that is fixedly arranged. In this constitution, the correspondence between the point in time where the drawing ball 73 retained inside of the drawing pocket 51 is detected by the second ball sensor 55 and a time elapsed from that point in time until the mark sensor first detects a mark has a one to one relationship. Therefore, by measuring a time elapsed from the point in time where the second ball sensor 55 has detected the drawing ball 73 until the mark sensor detects a mark for the first time, the drawing pocket 51 into which the drawing ball 73 has entered can be identified based on the measurement result. Such a process can be performed by the second sensor control unit 38*b*. When two or more marks different from each other are provided, the drawing pocket 51 into which the drawing ball 73 has entered can be identified from the time elapsed from the point in time where the second ball sensor 55 has detected the drawing ball 73 until the mark sensor first detects a mark and its mark content.

Next, description will be given of the flow of a first center drawing (mechanical drawing) using the vertical ring drawing device 40 to be performed in the center drawing apparatus 3.

Figure 21:
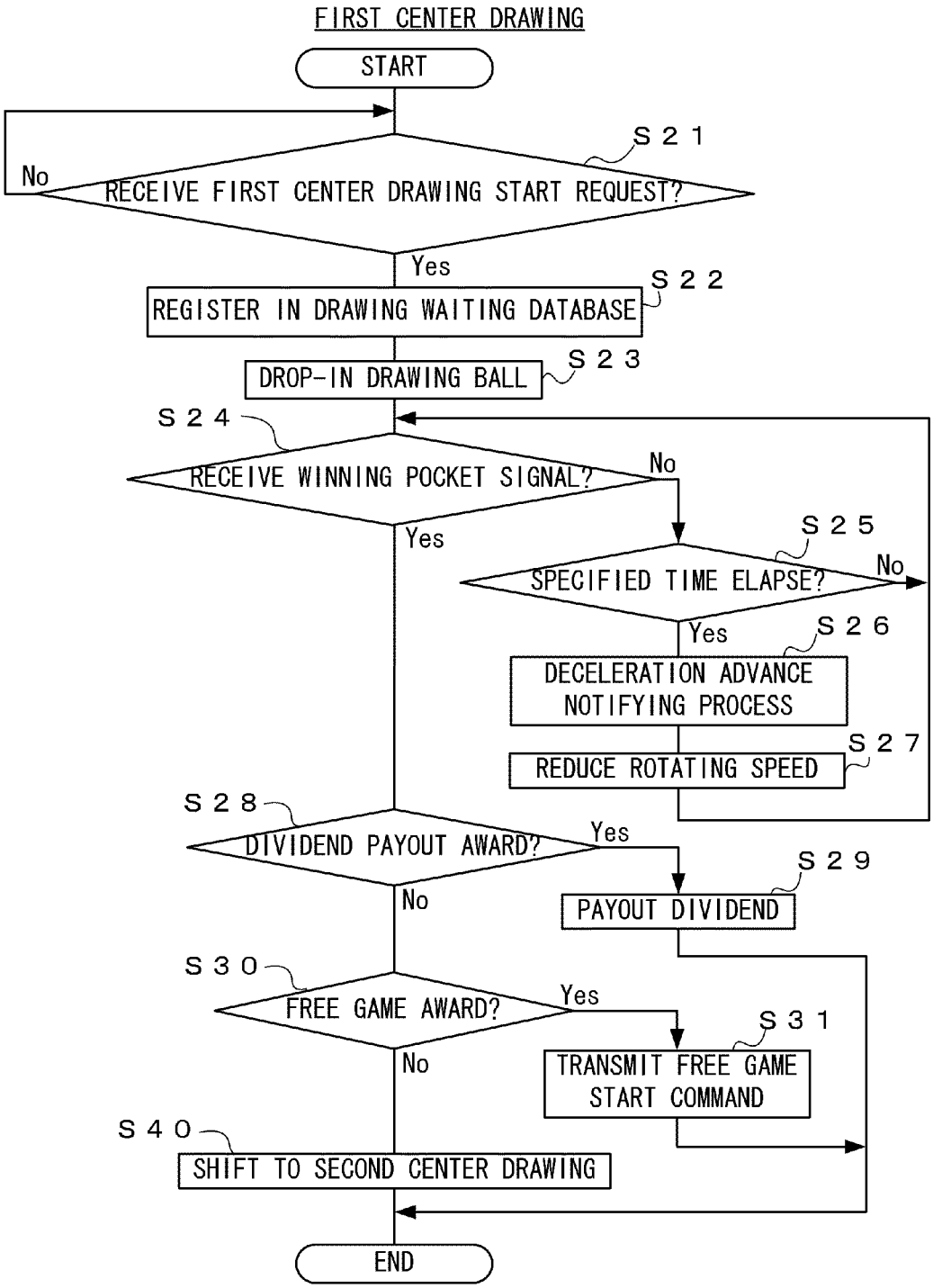
FIG. 21 is a flowchart showing the flow of one first center drawing.

FIG. 21 is a flowchart showing the flow of one first center drawing.

When the CPU 31 of the central control device 30 receives a first center drawing start request, via the input/output port 31*a*, from any of the station units 2 (S21), the CPU 31 registers a station ID to identify said station unit 2 in a drawing waiting database of the RAM 33 (S22). Then, in the order of receiving the first center drawing start requests, the CPU 31 sequentially performs first center drawings for the players of the station units 2. When starting the first center drawing, first, the CPU 31 outputs, to the table driving control unit 35, a drive command to make the station unit 2 of the player performing the first center drawing face the front of the vertical ring drawing device 40. Accordingly, the table driving control unit 35 rotationally drives the rotary table 64 so that the front of the vertical ring drawing device 40 faces that station unit 2. Thereafter, the CPU 31 outputs, to the transfer control unit 37, a command to send the drawing ball 73 to the ball drop-in opening 86*a*. The transfer control unit 37, upon receiving this command, rotationally drives a drive motor 81*b* of the transfer channel switching device 81 to rotate an eccentric cam 81*a* as shown in FIG. 18. Accordingly, the drawing ball 73 is dropped from the ball drop-in opening 86*a* through the fourth transfer rail 86 onto the non-pocket region on the inner peripheral surface of the vertical ring drawing device 40 (S23).

The drawing ball 73 that has been dropped onto the non-pocket region is restricted by the projection walls 43*a* while moving in a reciprocating manner like a pendulum on the non-pocket region along the circumferential direction of the vertical ring drawing device 40, and is gradually weakened in force. Then, when the relative moving speed with respect to the projection walls 43*a* is sufficiently reduced, the drawing ball 73 passes through the clearance between the projection walls 43*a* due to the inclination of the non-pocket region, and moves to the pocket region side. Thereafter, the drawing ball 73 that has moved onto the pocket region receives a certain external force from the surface of the pocket region on which the same moves while drifting on the pocket region, and enters into any of the drawing pockets 41 when passing through the drawing pocket 41.

Here, if the rotating speed of the vertical ring drawing device 40 is always constant, the surface moving speed of the pocket region also becomes constant, and the external force the drawing ball 73 receives from the surface of the pocket region also becomes constant. For this reason, such a situation that the drawing ball 73 on the pocket region continues rolling on an orbit to avoid the drawing pockets 41, and the drawing ball 73 never enters into the drawing pocket 41 can occur. Therefore, in the present embodiment, a constitution for timing by a timing unit (not shown) the time elapsed since the drawing ball 73 was dropped into the vertical ring drawing device 40 is provided. Then, the CPU 31 determines, based on the elapsed time timed by the timing unit, whether a predetermined specified time has elapsed (S25). This specified time can be arbitrarily set. In the present embodiment, this specified time is set to a period such as to allow securing a sufficient time required until the drawing ball enters into the drawing pocket 41 unless the drawing ball 73 falls into such a situation that the drawing ball 73 on the pocket region continues rolling on such an orbit as to avoid the drawing pockets 41 (in the usual case). Therefore, in the usual case, the drawing ball 73 enters into any of the drawing pockets 41 before the specified time has elapsed, and a winning pocket signal corresponding to that drawing pocket 41 is output to the CPU 31 from the first sensor control unit 38*a* (S24).

On the other hand, when the specified time has elapsed without the CPU 31 receiving a winning pocket signal (Yes in S25), the CPU 31 first performs a deceleration advance notifying process (S26). This deceleration advance notifying process is a process for making the first display device 71 display a countdown image to notify in advance the player of when the rotating speed of the vertical ring drawing device 40 will be reduced. When described in detail, the CPU 31 that has determined that the specified time has elapsed sends a countdown performance command to the display control unit 36. The display control unit 36, upon receiving this countdown performance command, performs display control to make the first display device 71 display a countdown image. Then, the CPU 31, almost simultaneously with the timing at which the countdown image switches to an image showing a deceleration timing, performs a process for reducing the rotating speed of the vertical ring drawing device 40 by the first rotation control unit 34*a* (S27).

If the drawing ball 73 has entered into any of the drawing pocket 41 and the CPU 31 has received its winning pocket signal after the specified time has elapsed and before the rotating speed of the vertical ring drawing device 40 is reduced, the countdown performance is cancelled at that point in time, and the process for reducing the rotating speed of the vertical ring drawing device 40 (S27) is also not performed.

Further, when such a situation is assumed that the drawing ball 73 does not enter into the drawing pocket 41 and is put on another orbit to continue avoiding the drawing pockets 41 even after the rotating speed of the vertical ring drawing device 40 has been reduced, such a constitution, for example, of timing a time elapsed since deceleration by the timing unit, and when the elapsed time has passed over a predetermined time (which may be set to a period different from that of the above-described specified time), further reducing the rotating speed of the vertical ring drawing device 40 after performing a deceleration advance notifying process or conversely increasing the rotating speed can also be adopted.

When the rotating speed of the vertical ring drawing device 40 is reduced as in the present embodiment, the surface moving speed of the pocket region varies, which can thus change the external force that the drawing ball 73 receives from the surface of the pocket region (rolling surface) on which the same moves. Accordingly, even when the drawing ball 73 rolling on the pocket region is put on an orbit to continue avoiding the drawing pockets 41, the drawing ball 73 can be deviated from the orbit. As a result, the occurrence of a situation that the drawing ball 73 rolling on the pocket region never enters into the drawing pocket 41 can be prevented.

When the dropped drawing ball 73 has entered into any of the drawing pockets 41 and the CPU 31 has received a winning pocket signal corresponding to that drawing pocket 41 from the first sensor control unit 38*a* (Yes in S24), the CPU 31 refers to a first award determination table stored in the RAM 33 to determine an award corresponding to that winning pocket signal. In the present embodiment, awards that can be won in the first center drawing are roughly divided into a payout award (dividend payout award) to pay out the quantity of credit corresponding to the award to the player, a free game award for starting a free game being a special game in a slot game that is performed in the station unit 2, and a second center drawing award for performing a second center drawing using the inclined ring drawing device 50. Then, the CPU 31, based on the winning pocket signal received from the first sensor control unit 38*a* and the first award determination table, identifies an award won by this time of first center drawing.

When winning of the dividend payout award has been determined (Yes in S28), the CPU 31 controls the first display device 71 and other performance units (illumination unit, sound outputting unit, and so on) to carry out predetermined performances. Then, the CPU 31 serving as a payout processing unit functions as payout processing means to transmit a dividend payout command from the input/output port 31*a* to the station control device 20 of the station unit 2 (S29). The CPU 21 of the station control device 20 that has received this dividend payout command performs a payout process for adding the credit quantity equivalent according to the dividend payout command to the credit data stored in the RAM 23.

Further, when winning of the free game award has been determined (Yes in S30), the CPU 31 controls the first display device 71 and other performance units (illumination unit, sound outputting unit, and so on) to carry out predetermined performances. Then, the CPU 31 transmits a free game start command from the input/output port 31*a* to the station control device 20 of the station unit 2 (S31). The CPU 21 of the station control device 20 that has received this free game start command executes a program for the free game, and controls the progress of the free game until a predetermined free game finishing condition is satisfied. The free game of the present embodiment is a slot game that can be played without betting credit, and the content of the slot game may be the same as or different from that of a normal slot game. In addition, a bonus game award to start a bonus game (which may be a game other than a slot game) being a special game may be adopted in place of the free game award.

Further, when winning of the second center drawing award has been determined (No in S30), the CPU 31 controls the first display device 71 and other performance units (illumination unit, sound outputting unit, and so on) to carry out predetermined performances. Then, the CPU 31 shifts to an operation mode of performing a second center drawing (S40).

Next, description will be given of the flow of the second center drawing (mechanical drawing) using the inclined ring drawing device 50 to be performed in the center drawing apparatus 3.

Figure 22:
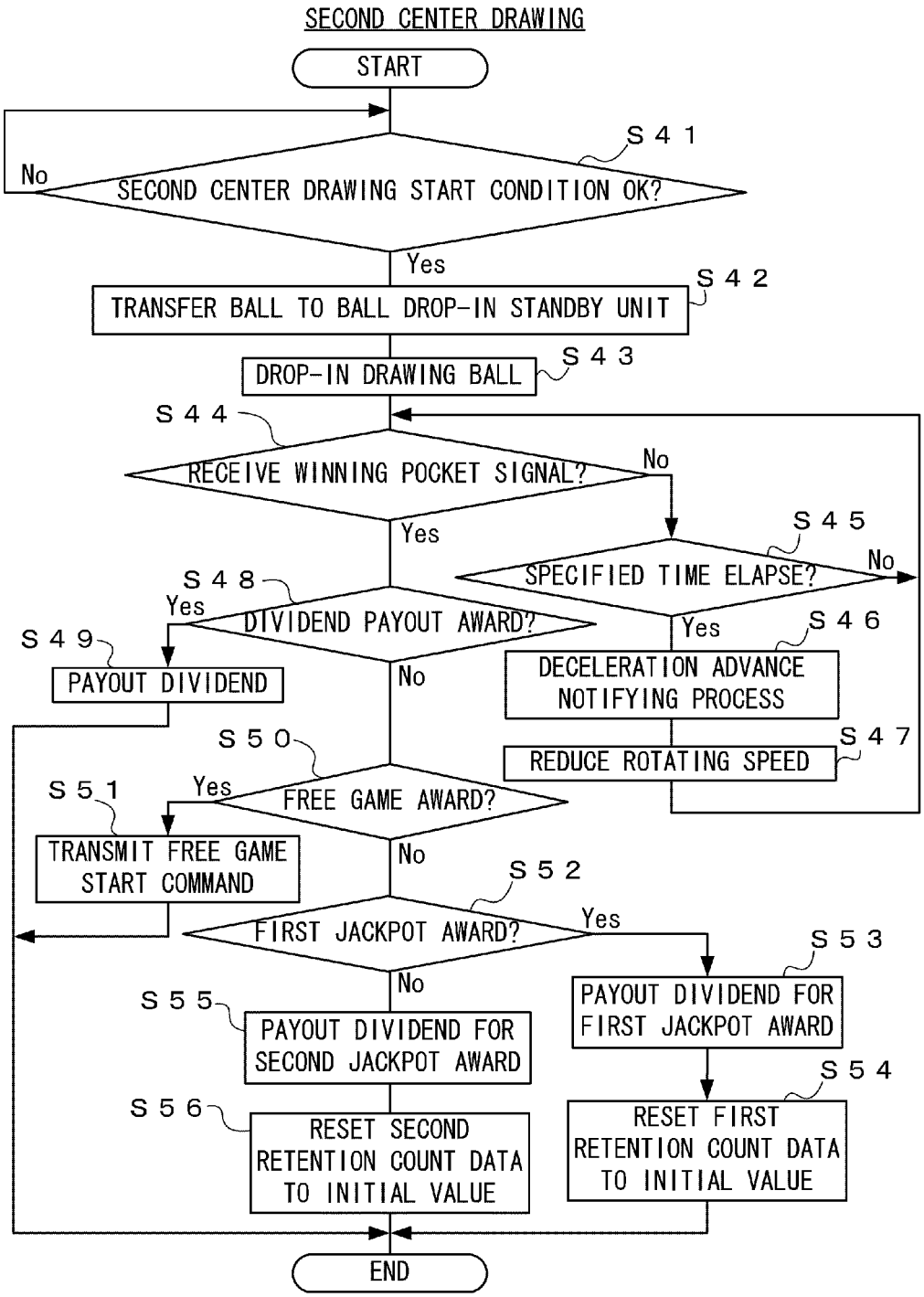
FIG. 22 is a flowchart showing the flow of one second center drawing.

FIG. 22 is a flowchart showing the flow of one second center drawing.

When a second center drawing starting condition that the CPU 31 of the central control device 30 receives a second center drawing start request, via the input/output port 31*a*, from any of the station units 2 or that winning of the second center drawing award has been determined in the first center drawing is satisfied (S41), the CPU 31 performs a second center drawing for the player of that station unit 2. When starting the second center drawing, the CPU 31 outputs, to the table driving control unit 35, a drive command to make the station unit 2 of the player performing the second center drawing face the front of the inclined ring drawing device 50. Accordingly, the table driving control unit 35 rotationally drives the rotary table 64 so that the front of the inclined ring drawing device 50 faces that station unit 2.

Thereafter, the CPU 31 outputs, to the transfer control unit 37, a command to send the drawing ball 73 to the ball drop-in standby unit 83. Here, the transfer control unit 37 performs an operation different depending on the difference in the satisfied second center drawing start condition. Concretely, when the second center drawing start condition has been satisfied by receiving a second center drawing starting request from the station unit 2, the transfer control unit 37 rotationally drives the drive motor 81*b* of the transfer channel switching device 81 to rotate the eccentric cam 81*a* as shown in FIG. 19. Accordingly, the drawing ball 73 is transferred through the second transfer rail 84 to the ball drop-in standby unit 83 (S42). On the other hand, when the second center drawing start condition has been satisfied by that winning of the second center drawing award has been determined in the first center drawing, the transfer control unit 37 moves the shutter 47*c* provided on the first ball discharge unit 48 of the vertical ring drawing device 40 to the ball discharging position as shown in FIG. 14, and moves the shutter 82*b* provided on the fall opening 82*a* of the first transfer rail 82 to the closing position as shown in FIG. 15. Accordingly, the drawing ball 73 that has entered into the drawing pocket 41 corresponding to the second center drawing award of the first center drawing is transferred from the first ball discharge unit 48 through the first transfer rail 82 to the ball drop-in standby unit 83 (S42).

Next, the CPU 31 outputs, to the transfer control unit 37, a drop-in command of the drawing ball 73. The transfer control unit 37 that has received this drop-in command performs drive control to move the shutter 83*a* that has blocked the drawing ball 73 in the ball drop-in standby unit 83, as shown in FIG. 8. Accordingly, the drawing ball 73 that has been blocked by the shutter 83*a* is dropped onto the slope 54*a* of the inclined ring drawing device 50 (S43).

Here, if the rotating speed of the inclined ring drawing device 50 is always constant, the relative moving speed of the drawing pocket 51 with respect to the slope 54*a* also becomes constant, and thus for example, even with the force of the drawing ball 73 sufficiently weakened, the drawing ball 73 may fall into such a situation that this is flicked by an opening edge part (partition member 52) of the drawing pocket 51 every time in the same manner. Therefore, in the present embodiment, a constitution for timing by a timing unit (not shown) the time elapsed since the drawing ball 73 was dropped into the inclined ring drawing device 50 is provided. Then, the CPU 31 determines, based on the elapsed time timed by the timing unit, whether a predetermined specified time has elapsed (S45). This specified time can be arbitrarily set. In the present embodiment, this specified time is set to a period such as to allow securing a sufficient time required until the drawing ball 73 enters into the drawing pocket 51 unless the drawing ball 73 on the slope 54*a* falls into such a situation as described above (in the usual case). Therefore, in the usual case, the drawing ball 73 enters into any of the drawing pockets 51 before the specified time has elapsed, and a winning pocket signal corresponding to that drawing pocket 51 is output to the CPU 31 from the second sensor control unit 38*b* (S44).

On the other hand, when the specified time has elapsed without the CPU 31 receiving a winning pocket signal (Yes in S45), the CPU 31 first performs a deceleration advance notifying process (S46). This deceleration advance notifying process is a process for making the second display device 72 display a countdown image to notify in advance the player of when the rotating speed of the inclined ring drawing device 50 will be reduced. When described in detail, the CPU 31 that has determined that the specified time has elapsed sends a countdown performance command to the display control unit 36. The display control unit 36, upon receiving this countdown performance command, performs display control to make the second display device 72 display a countdown image. Then, the CPU 31, almost simultaneously with the timing at which the countdown image switches to an image showing a deceleration timing, performs a process for reducing the rotating speed of the inclined ring drawing device 50 by the second rotation control unit 34*b* (S47).

If the drawing ball 73 has entered into any of the drawing pockets 51 and the CPU 31 has received its winning pocket signal after the specified time has elapsed and before the rotating speed of the inclined ring drawing device 50 is reduced, the countdown performance is cancelled at that point in time, and the process for reducing the rotating speed of the inclined ring drawing device 50 (S47) is also not performed.

Further, when it is assumed that the drawing ball 73 does not enter into the drawing pocket 51 and falls into such a situation as described above even after the rotating speed of the inclined ring drawing device 50 has been reduced, such a constitution, for example, of timing a time elapsed since deceleration by the timing unit, and when the elapsed time has passed over a predetermined time (which may be set to a period different from that of the above-described specified time), further reducing the rotating speed of the inclined ring drawing device 50 after performing a deceleration advance notifying process or conversely increasing the rotating speed can also be adopted.

When the rotating speed of the inclined ring drawing device 50 is reduced as in the present embodiment, the relative moving speed of the drawing pocket 51 with respect to the slope 54*a* varies, which can thus change such a situation as described above. Accordingly, the occurrence of a situation that the drawing ball 73 rolling on the slop 54*a* never enters into the drawing pocket 51 can be prevented.

When the dropped drawing ball 73 has entered into any of the drawing pockets 51 and the CPU 31 has received a winning pocket signal corresponding to that drawing pocket 51 from the second sensor control unit 38*b* (S44), the CPU 31 refers to a second award determination table stored in the RAM 33 to determine an award corresponding to that winning pocket signal. In the present embodiment, awards that can be won in the second center drawing are roughly divided into a payout award (dividend payout award) to pay out the quantity of credit corresponding to the award to the player, a free game award for starting a free game being a special game in a slot game that is performed in the station unit 2, a first jackpot award, and a second jackpot award. Then, the CPU 31, based on the winning pocket signal received from the second sensor control unit 38*b* and the second award determination table, identifies an award won by this time of second center drawing.

Here, in the present embodiment, two types of jackpot awards exist. The first jackpot award is an award that tokens (credit) corresponding to the first jackpot retention count (payout amount) are paid out to the player playing at the station unit 2. The first retention count data (payout amount data) indicating the first jackpot retention count is stored in the RAM 33 of the central control device 30. A count value of the first retention count data, that is, the first jackpot retention count, is obtained by accumulatively adding the amount (for example, 0.03) equivalent to a part of the bet amount every time credit is bet at all of the station units 2 with respect to a predetermined initial value (for example, 500 pieces).

The second jackpot award is an award that tokens (credit) corresponding to the second jackpot retention count (payout amount) are paid out to the player playing at the station unit 2. The second retention count data (payout amount data) indicating the second jackpot retention count is also stored in the RAM 33 of the central control device 30. A count value of the second retention count data, that is, the second jackpot retention count, is also obtained by accumulatively adding the amount (for example, 0.03) equivalent to a part of the bet amount every time credit is bet at all of the station units 2 with respect to a predetermined initial value (for example, 500 pieces).

Although, in the present embodiment, jackpot retention count increasing conditions are the same between the first jackpot award and the second jackpot award, these may be different from each other.

When winning of the dividend payout award has been determined (Yes in S48), the CPU 31 controls the second display device 72 and other performance units (illumination unit, sound outputting unit, and so on) to carry out predetermined performances. Then, the CPU 31 serving as a payout processing unit functions as payout processing means to transmit a dividend payout command from the input/output port 31*a* to the station control device 20 of the station unit 2 (S49). The CPU 21 of the station control device 20 that has received this dividend payout command performs a payout process for adding the credit quantity equivalent according to the dividend payout command to the credit data stored in the RAM 23. It is preferable to set the dividend of the dividend payout award in the second center drawing to be higher than that of the dividend payout award in the first drawing.

Further, when winning of the free game award has been determined (Yes in S50), the CPU 31 controls the second display device 72 and other performance units (illumination unit, sound outputting unit, and so on) to carry out predetermined performances. Then, the CPU 31 transmits a free game start command from the input/output port 31*a* to the station control device 20 of the station unit 2 (S51). The CPU 21 of the station control device 20 that has received this free game start command executes a program for the free game, and controls the progress of the free game in the same manner as in the case of a free game award of the first center drawing until predetermined free game finishing conditions are satisfied. As a matter of course, a bonus game award to start a bonus game (which may be a game other than a slot game) being a special game may be adopted in place of the free game award. It is preferable that the free game to be executed as a result of winning the free game award in the second center drawing is set so as to have conditions advantageous to the player, such as relaxing predetermined free game finishing conditions as compared with those for the free game to be executed as a result of winning the free game award in the first center drawing.

Further, when winning of the first jackpot award has been determined (Yes in S52), the CPU 31 controls the second display device 72 and other performance units (illumination unit, sound outputting unit, and so on) to carry out predetermined performances. Then, the CPU 31 serving as a payout processing unit functions as payout processing means to read out first retention count data from the RAM 33, and performs a process for paying out credit of the quantity indicated by a count value of that data to the player playing at the station unit 2 (S53). Concretely, for example, in the same manner as in the case of a dividend payout award, the CPU 31 transmits a dividend payout command from the input/output port 31*a* to the station control device 20 of the station unit 2. Alternatively, the payout may be carried out by way of an attendant pay in which an attendant in the gaming facility pays out tokens for the player directly. Further, the CPU 31 resets the first retention count data stored in the RAM 33 to an initial value (S54).

Further, when winning of the second jackpot award has been determined (No in S52), the CPU 31 controls the second display device 72 and other performance units (illumination unit, sound outputting unit, and so on) to carry out predetermined performances. Then, the CPU 31 serving as a payout processing unit functions as payout processing means to read out second retention count data from the RAM 33, and performs, by the same method or a different method from that in the case of a first jackpot award, a process for paying out credit of the quantity indicated by a count value of that data to the player playing at the station unit 2 (S55). Further, the CPU 31 resets the second retention count data stored in the RAM 33 to an initial value (S56).

In the present embodiment, even when a player who plays at any one of the station units 2 wins the first jackpot award, the second retention count data related to the second jackpot award is not reset. Similarly, even when a player who plays at any one of the station units 2 wins the second jackpot award, the first retention count data related to the first jackpot award is not reset. That is, even after any player wins either one of the jackpot awards, a retention count of the other jackpot award is kept as it is. Therefore, where any player wins either one of the jackpot awards, the remaining players have a lower desire for winning that jackpot award but strongly desire winning the other jackpot award. As a result, such an effect is expected that even when any player wins either one of the jackpot awards, gaming characteristics are never reduced for other players but raised further.

In the present embodiment, a description has been given, as an example, of the token-operated game machine that controls game progress on the condition where tokens are received (bet object) from a player, but the present invention can also be similarly applied to a game apparatus and so on to be installed in a casino and so on that controls game progress on the condition where money is directly received.

Further, in the present embodiment, a description has been given for the case where a mechanical drawing of determining, using the center drawing apparatus 3, an award to be won depending on which of the pluralities of drawing pockets 41, 51 the drawing ball 73 being a drawing object has entered into, but another type of mechanical drawing may be performed by using the center drawing apparatus 3. The present invention can also be applied, for example, by applying the center drawing apparatus 3 to a bingo game machine, to a mechanical drawing of allocating bingo numbers to the drawing pockets 41, 51, respectively, and then sequentially determining the bingo numbers allocated to the drawing pockets 41, 51 into which the drawing balls 73 being drawing objects have entered as winning bingo numbers. In this case, when the case using the vertical ring drawing device 40 is raised as an example, by dropping the drawing ball 73 a plurality of number of times with the shutter 47*c* provided on the first ball discharge unit 48 moved to the ball passing position as shown in FIG. 13, the drawing pocket 41 in which the drawing ball 73 is already entered is blocked by that drawing ball 73, and thus a situation where the same bingo numbers are repeatedly won can be prevented, and a speedy bingo drawing is enabled, which is helpful.

Further, in the present embodiment, by dropping the drawing ball 73 a plurality of number of times with the shutter 47*c* provided on the first ball discharge unit 48 moved to the ball passing position as shown in FIG. 13, the drawing pocket 41 in which the drawing ball 73 is already entered is blocked by that drawing ball 73, and thus a subsequent drawing ball enters into any of the remaining drawing pockets 41. With such a constitution, when there is, for example, a game setting so that winning the second center drawing award becomes the biggest goal, it becomes possible to provide such game attractiveness that the probability that, when the drawing ball 73 dropped first enters into the drawing pocket 41 to which an award other than the second center drawing award has been allocated, the drawing ball 73 dropped next enters into the drawing pocket 41 to which the second center drawing award has been allocated becomes higher. Although this explanation is for the case with the vertical ring drawing device 40, the same applies also to the case with the inclined ring drawing device 50.

In the above-described embodiment, means realized by software such as a computer program may be optionally realized by hardware such as a circuit board and a chip. Moreover, means realized by hardware such as a circuit board and a chip may be optionally realized by software such as a computer program.

The invention claimed is:

1. A mechanical drawing machine which performs a drawing by moving a drawing object and depending on which of a plurality of drawing pockets the drawing object enters into, comprising:

a stationary base;

a drawing pocket forming member which forms the drawing pockets, and can hold a drawing object having entered into each drawing pocket inside of the drawing pocket while rotationally moving so as to pass through a site adjacent to the stationary base;

a driving unit which drives the drawing pocket forming member so as to rotationally move;

an object detecting unit which is provided on the stationary base, and detects that a drawing object which is held inside of the drawing pocket has passed through an object detecting site on an orbit of the drawing pockets;

a mark forming and moving member which forms a plurality of mutually different marks, each of which has mark content indicative of where the mark is located on the drawing pocket forming member, and rotationally moves the marks in synchronization with rotational movement of the drawing pocket forming member;

a mark content reading unit which is provided on the stationary base, wherein when each mark passes through a mark detecting site on an orbit of the marks, the mark content reading unit reads the marks content of the mark; and a pocket identifying unit which, based on a timing at which the object detecting unit detects passage of a drawing object and the mark content read by the mark content reading unit, identifies a drawing pocket into which the drawing object has entered.

2. The mechanical drawing machine according to claim 1, wherein the marks are different in combination of the presence and absence of a plurality of mark pieces from each other, and the mark content reading unit detects, as the mark content, the presence and absence of the mark pieces by mark piece detecting sensors of the same number as the maximum number of the mark pieces when each mark passes through the mark detecting site, and reads a combination of detection results of the mark piece detecting sensors as the mark content.

3. The mechanical drawing machine according to claim 1, compromising a mark content storage unit which stores at least the latest mark content out of the mark contents read by the mark content reading unit every time each mark passes through the mark detecting site, and wherein the pocket identifying unit, based on the latest mark content stored in the mark content storage unit when the object detecting unit has detected passage of a drawing object, identifies a drawing pocket into which the drawing object has entered.

4. The mechanical drawing machine according to claim 1, wherein the pocket identifying unit, based on a mark content read by the mark content reading unit when or after the object detecting unit has detected passage of a drawing object, identifies a drawing pocket into which the drawing object has entered.

5. The mechanical drawing machine according to claim 1, wherein the mark forming and moving member is fixed to the drawing pocket forming member so that the marks rotationally move as a result of driving of the drawing pocket forming member.

6. The mechanical drawing machine according to claim 1, wherein a plurality of object detecting units are provided so as to be able to detect that a drawing object which is held inside of the drawing pocket has passed through a plurality of mutually different object detecting sites on an orbit of the drawing pockets.

7. The mechanical drawing machine according to claim 6, wherein at least two or more object detecting sites out of the object detecting sites are dispersed in a region where a plurality of drawing pockets to which a drawing object is accessible are located.

8. The mechanical drawing machine according to claim 1, wherein the object detecting site is arranged on a downstream side in a drawing pocket-rotational movement direction of a region where a drawing pocket to which a drawing object is accessible is located.

9. A mechanical drawing machine which performs a drawing by moving a drawing object and depending on which of a plurality of drawing pockets the drawing object enters into, comprising: a stationary base;

a drawing pocket forming member which forms the drawing pockets, and can hold a drawing object having entered into each drawing pocket inside of the drawing pocket while rotationally moving so as to pass through a site adjacent to the stationary base;

a driving unit which drives the drawing pocket forming member so as to rotationally move;

an object detecting unit which is provided on the stationary base, and detects that the drawing object which is held inside of the drawing pocket has passed through an object detecting site on an orbit of the drawing pockets;

a mark forming and moving member which rotationally moves one or two or more marks in synchronization with rotational movement of the drawing pocket forming member;

a mark detecting unit which is provided on the stationary base, and detects that the one or two or more marks have passed through a mark detecting site on an orbit of the mark or marks; and a pocket identifying unit which, based on a measurement result of time elapsed from a timing at which the object detecting unit detects a drawing object until a timing at which the mark detecting unit detects a mark, identifies a drawing pocket into which the drawing object has entered.

10. The mechanical drawing machine according to claim 9, wherein the mark forming and moving member is fixed to the drawing pocket forming member so that the marks rotationally move as a result of driving of the drawing pocket forming member.

11. The mechanical drawing machine according to claim 9, wherein a plurality of object detecting units are provided so as to be able to detect that a drawing object which is held inside of the drawing pocket has passed through a plurality of mutually different object detecting sites on an orbit of the drawing pockets.

12. The mechanical drawing machine according to claim 11, wherein at least two or more object detecting sites out of the object detecting sites are dispersed in a region where a plurality of drawing pockets to which a drawing object is accessible are located.

13. The mechanical drawing machine according to claim 9, wherein the object detecting site is arranged on a downstream side in a drawing pocket-rotational movement direction of a region where a drawing pocket to which a drawing object is accessible is located.

14. A game apparatus comprising: a mechanical drawing machine which performs a drawing by moving a drawing object and depending on which of a plurality of drawing pockets the drawing object enters into; and a game progress control unit which performs control of game progress by use of a result of a mechanical drawing using the mechanical drawing machine by executing a predetermined game program, or controls game progress by executing a predetermined game program and performs control to start a mechanical drawing using the mechanical drawing machine according to a result of the game progress, wherein the mechanical drawing machine includes: a stationary base;

a drawing pocket forming member which forms the drawing pockets, and can hold a drawing object having entered into each drawing pocket inside of the drawing pocket while rotationally moving so as to pass through a site adjacent to the stationary base;

a driving unit which drives the drawing pocket forming member so as to rotationally move;

an object detecting unit which is provided on the stationary base, and detects that a drawing object which is held inside of the drawing pocket has passed through an object detecting site on an orbit of the drawing pockets;

a mark forming and moving member which forms a plurality of mutually different marks, each of which has mark content indicative of where the mark is located on the drawing pocket forming member, and rotationally moves the marks in synchronization with rotational movement of the drawing pocket forming member;

a mark content reading unit which is provided on the stationary base, wherein when each mark passes through a mark detecting site on an orbit of the marks, the mark content reading unit reads the mark content of the mark; and a pocket identifying unit which, based on a timing at which the object detecting unit detected passage of a drawing object and the mark content read by the mark content reading unit, identifies a drawing pocket into which the drawing object has entered.

15. A game apparatus comprising: a mechanical drawing machine which performs a drawing by moving a drawing object and depending on which of a plurality of drawing pockets the drawing object enters into; and a game progress control unit which performs control of game progress by use of a result of a mechanical drawing using the mechanical drawing machine by executing a predetermined game program, or controls game progress by executing a predetermined game program and performs control to start a mechanical drawing using the mechanical drawing machine according to a result of the game progress, wherein the mechanical drawing machine includes: a stationary base;

a drawing pocket forming member which forms the drawing pockets, and can hold a drawing object having entered into each drawing pocket inside of the drawing pocket while rotationally moving so as to pass through a site adjacent to the stationary base;

a driving unit which drives the drawing pocket forming member so as to rotationally move;

an object detecting unit which is provided on the stationary base, and detects that a drawing object which is held inside of the drawing pocket has passed through an object detecting site on an orbit of the drawing pockets;

a mark forming and moving member which rotationally moves one or two or more marks in synchronization with rotational movement of the drawing pocket forming member;

a mark detecting unit which is provided on the stationary base, and detects that the one or two or more marks have passed through a mark detecting site on an orbit of the mark or marks; and a pocket identifying unit which, based on a measurement result of time elapsed from a timing at which the object detecting unit detects a drawing object until a timing at which the mark detecting unit detects a mark, identifies a drawing pocket into which the drawing object has entered.

* * * * *